US012331641B2

(12) United States Patent
Pai et al.

(10) Patent No.: US 12,331,641 B2
(45) Date of Patent: Jun. 17, 2025

(54) PULSED-POWER DRILLING SYSTEM WITH INTEGRATED POWER AND COMMUNICATION COILED TUBING CONVEYANCE

(71) Applicant: Halliburton Energy Services, Inc., Houston, TX (US)

(72) Inventors: Nagaraja K. Pai, Houston, TX (US); Robert Charles De Long, Tulsa, OK (US); Wei Zhang, Houston, TX (US); Lucas Samuel Batista Santos, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/244,729

(22) Filed: Sep. 11, 2023

(65) Prior Publication Data

US 2025/0084706 A1 Mar. 13, 2025

(51) Int. Cl.
*E21B 7/15* (2006.01)
*E21B 17/02* (2006.01)

(52) U.S. Cl.
CPC ..... *E21B 7/15* (2013.01); *E21B 17/028* (2013.01)

(58) Field of Classification Search
CPC ..... E21B 17/028; E21B 7/15
See application file for complete search history.

(56) References Cited

U.S. PATENT DOCUMENTS 3,835,929 A * 9/1974 Suman, Jr. ..... E21B 17/1035 166/66.4
5,348,097 A * 9/1994 Giannesini ..... E21B 47/00 166/385
5,435,351 A * 7/1995 Head ..... H02G 1/08 138/113
5,992,468 A * 11/1999 Dwiggins ..... E21B 23/01 138/131

(Continued)

FOREIGN PATENT DOCUMENTS

CN 106014289 A 10/2016
WO 2013059315 A1 4/2013
WO 2022140719 A1 6/2022

OTHER PUBLICATIONS

Foreign Communication from Related Application—International Search Report and Written Opinion of the International Searching Authority, International Application No. PCT/US2023/033704, dated Jun. 4, 2024, 12 pages.

(Continued)

*Primary Examiner* — Giovanna Wright
(74) *Attorney, Agent, or Firm* — Conley Rose, P.C.; Rodney B. Carroll

(57) ABSTRACT

Disclosed embodiments relate to a pulsed-power drilling system, in which a pulsed-power drill is conveyed downhole and operated via coiled tubing. The coiled tubing may be configured to simultaneously transmit power and drilling fluid downhole. For example, the coiled tubing may include a flexible hollow fluid tube configured to transport drilling fluid therein, and a flexible cable tube disposed within the (Continued)

fluid tube. The cable tube may have one or more cable disposed within protective tubing, protecting the cables from drilling fluid in the fluid tube. Methods of making and using such coiled tubing with pulsed-power drills are also disclosed.

20 Claims, 10 Drawing Sheets

(56) References Cited

U.S. PATENT DOCUMENTS

| | | | | |
|---|---|---|---|---|
| 6,015,015 | A | 1/2000 | Luft et al. | |
| 6,332,499 | B1 * | 12/2001 | Kobylinski | E21B 17/028 166/242.6 |
| 7,073,582 | B2 | 7/2006 | Connell et al. | |
| 9,708,867 | B2 * | 7/2017 | Lovell | E21B 34/066 |
| 11,326,399 | B2 | 5/2022 | Gleitman et al. | |
| 11,512,539 | B2 | 11/2022 | Perez et al. | |
| 2002/0112861 | A1 * | 8/2002 | Restarick | E21B 17/206 166/242.6 |
| 2003/0213601 | A1 | 11/2003 | Schwendemann et al. | |
| 2005/0199392 | A1 | 9/2005 | Connell et al. | |
| 2006/0151179 | A1 | 7/2006 | Boyadjieff et al. | |
| 2008/0277508 | A1 * | 11/2008 | Moeny | E21B 7/15 241/1 |
| 2008/0308280 | A1 * | 12/2008 | Head | H02G 1/086 166/384 |
| 2011/0024103 | A1 | 2/2011 | Storm, Jr. et al. | |
| 2012/0055672 | A1 | 3/2012 | Tollefsen et al. | |
| 2012/0160361 | A1 | 6/2012 | Fischer et al. | |
| 2014/0008968 | A1 | 1/2014 | Moeny | |
| 2015/0162730 | A1 * | 6/2015 | D'Silva | E21B 17/003 174/68.3 |
| 2015/0184468 | A1 | 7/2015 | Sherman | |
| 2015/0204143 | A1 | 7/2015 | Mueller et al. | |
| 2016/0273309 | A1 | 9/2016 | Maher et al. | |
| 2017/0342782 | A1 | 11/2017 | Livescu et al. | |
| 2018/0023731 | A1 | 1/2018 | Varkey et al. | |
| 2018/0148981 | A1 | 5/2018 | Moeny | |
| 2018/0163478 | A1 | 6/2018 | Dirksen et al. | |
| 2018/0374607 | A1 | 12/2018 | Hernandez Marti et al. | |
| 2020/0269276 | A1 | 8/2020 | Perez et al. | |
| 2020/0370375 | A1 | 11/2020 | Gleitman et al. | |
| 2021/0324683 | A1 | 10/2021 | Gleitman et al. | |
| 2022/0065090 | A1 * | 3/2022 | Ejim | E21B 47/008 |
| 2022/0384105 | A1 | 12/2022 | Wiecek et al. | |
| 2023/0095574 | A1 | 3/2023 | Cooley et al. | |
| 2023/0102801 | A1 | 3/2023 | Parrella et al. | |
| 2023/0184043 | A1 | 6/2023 | Hay | |

OTHER PUBLICATIONS

Foreign Communication from Related Application—International Search Report and Written Opinion of the International Searching Authority, International Application No. PCT/US2023/073586, dated May 31, 2024, 11 pages.

Office Action dated Jul. 8, 2024 (26 pages), U.S. Appl. No. 18/461,068, filed Sep. 5, 2023.

* cited by examiner

PULSED-POWER DRILLING SYSTEM WITH INTEGRATED POWER AND COMMUNICATION COILED TUBING CONVEYANCE

FIELD

The present disclosure relates generally to pulsed-power drilling operations and, more particularly, to systems and methods for pulsed-power drilling with coiled tubing conveyance.

BACKGROUND

Electrocrushing or electrohydraulic drilling uses pulsed-power technology to drill a wellbore in a rock formation. Pulsed-power technology repeatedly applies a high electric potential across the electrodes of a pulsed-power drill bit, which ultimately causes the surrounding rock to fracture. The fractured rock can be carried away from the bit by drilling fluid, and the bit advances downhole. Electrocrushing drilling operations may also be referred to as pulsed-power drilling operations.

BRIEF DESCRIPTION OF THE DRAWINGS

Embodiments of the disclosure may be better understood by referencing the accompanying drawings.

DESCRIPTION

Figure 1:
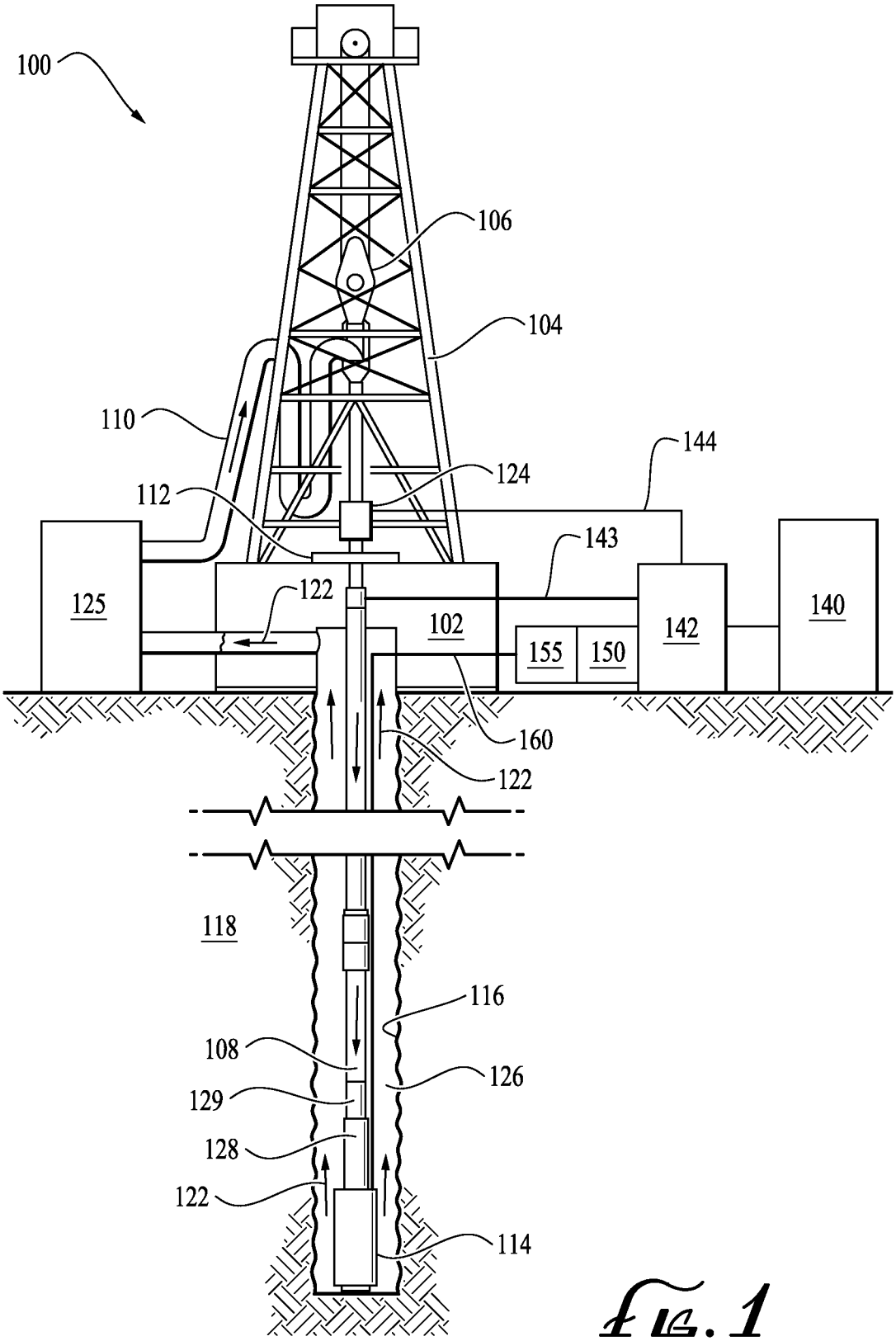
FIG. 1 is an elevation view of an exemplary pulsed-power drilling system used in a wellbore environment, according to embodiments of this disclosure.

The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description.

Electrocrushing or electrohydraulic drilling may be used to form wellbores in subterranean rock formations for recovering hydrocarbons, such as oil and gas, from these formations. Electrocrushing or electrohydraulic drilling uses pulsed-power technology to repeatedly fracture the rock formation by repeatedly delivering electrical arcs or high-energy shock waves to the rock formation. More specifically, a drill bit of a pulsed-power drilling system is excited by a train of high-energy electrical pulses that produce high power discharges through the formation at the downhole end of the drill bit. The high-energy electrical pulses, in turn, fracture part of the formation surrounding the drilling tool and produce electromagnetic and acoustic waves. Typically, the pulsed-power drill bit may be conveyed into the wellbore and thereby moved and positioned downhole within the wellbore by a conveyance mechanism. For example, the conveyance mechanism may be drill pipe extending downhole in some embodiments. Alternatively, coiled tubing may serve as the conveyance mechanism.

In embodiments, certain components of a pulsed-power drilling system may be located downhole. For example, an axial-field multi-armature alternator power system and/or a pulse-generating circuit may be located in a bottom-hole assembly (BHA) near the pulsed-power drill bit. In embodiments, the pulsed-power drill bit, axial-field multi-armature alternator power system, pulse-generating circuit, and/or BHA may be disposed at the downhole end of the conveyance mechanism. In some embodiments, the axial-field multi-armature alternator power system can provide power to the pulse-generating circuit at required power levels, e.g., 500 kilowatts or higher. While the axial-field multi-armature alternator power system (e.g. with power generation downhole, typically within drill pipe) can be configured to achieve the desired power output, e.g., the power needed by the pulsed-power drill bit, the complexities of power conversions can pose substantial challenges. This may be particularly true in light of the size and spacing constraints and/or downhole conditions when power is generated downhole in a wellbore.

In other embodiments, power for the pulsed-power drill may be delivered from the surface (e.g. from a generator located at the surface) to the pulsed-power drill bit and/or to the pulse-generating circuit (e.g. located at the BHA). In embodiments, the pulsed-power drill bit, the pulse-generating circuit, and/or the BHA can be configured to be conveyed downhole via a conveyance mechanism, such as coiled tubing. Improved techniques, such as those discussed herein, may be useful in effectively delivering or transmitting power (in addition to drilling fluid) downhole from the surface to the pulsed-power drill bit (e.g. through the conveyance mechanism). For example, all power generation for such systems may occur at the surface and be transmitted downhole via the coiled tubing. Embodiments of the present disclosure and its advantages are best understood by reference to the Figures, where like numbers are used to represent like parts.

FIG. 1 is an elevation view of an exemplary pulsed-power drilling system used to form a wellbore in a subterranean formation. Although FIG. 1 shows land-based equipment, downhole tools incorporating teachings of the present disclosure may be satisfactorily used with equipment located on offshore platforms, drill ships, semi-submersibles, and drilling barges (not expressly shown). Additionally, while wellbore 116 is shown as being a generally vertical wellbore, wellbore 116 may be or include any orientation including generally horizontal, multilateral, or directional.

The exemplary drilling system 100 includes drilling platform 102 that supports derrick 104 having traveling block 106 for raising and lowering drill string 108. Drilling system 100 also includes pump 125, which circulates pulsed-power drilling fluid 122 (e.g. drilling mud) through a feed pipe to kelly 110, which in turn conveys pulsed-power drilling fluid 122 downhole through interior channels of drill string 108 and through one or more orifices in pulsed-power drill bit 114. Pulsed-power drilling fluid 122 then circulates back to the surface via annulus 126 formed between drill string 108 and the sidewalls of wellbore 116. Fractured portions of the formation are carried to the surface by pulsed-power drilling fluid 122 to remove those fractured portions from wellbore 116.

Drilling fluid 122 may have rheological properties for removing cuttings from wellbore 116. Drilling fluid 122 may also have electrical properties conducive to particular pulse-powered drilling operations. Drilling fluid 122 may be or include oil-based fluids or water-based fluids, depending upon the particular pulsed power drilling approach used. Drilling fluid 122 may be formulated to have high dielectric strength and a high dielectric constant, so as to direct electrical arcs into the formation rather than them being short circuited through drilling fluid 122.

Figure 3A:
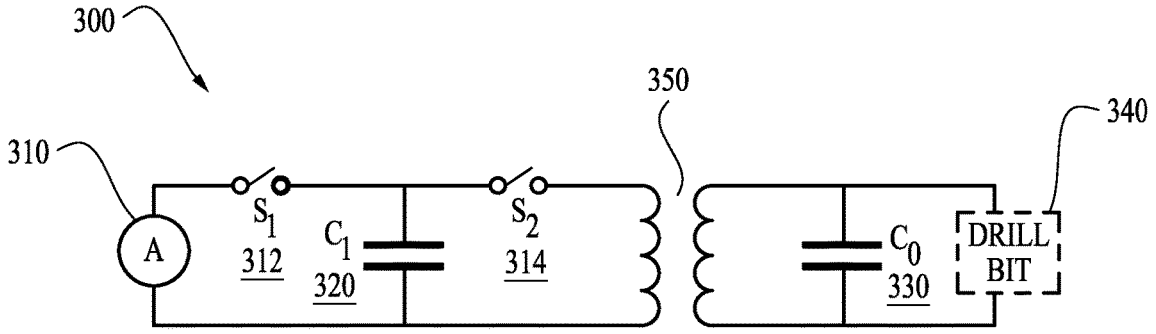
FIGS. 3A to 3C illustrate three exemplary pulse-generating circuits, according to embodiments of this disclosure.
Figure 3B:
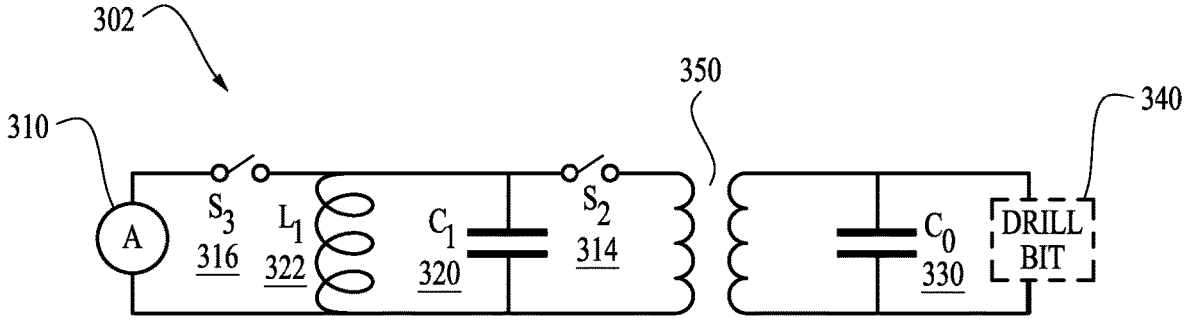
Figure 3C:
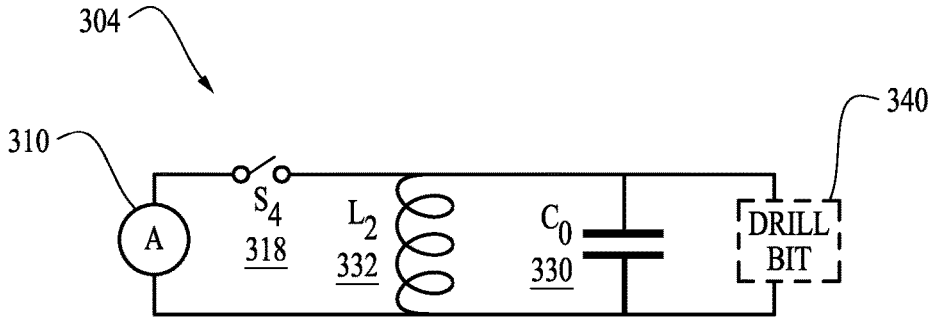

Pulsed-power drill bit 114 is attached to the distal end of drill string 108 and may be an electrocrushing drill bit or an electrohydraulic drill bit. Power may be supplied to drill bit 114 from components downhole, components at the surface and/or a combination of components downhole and at the surface. For example, generator 140 may generate electrical power and provide that power to power-conditioning unit 142. Power-conditioning unit 142 may then transmit electrical energy downhole via surface cable 143 and a subsurface cable (not expressly shown in FIG. 1) contained within drill string 108 or attached to the outer wall of drill string 108. While the drill string shown in FIG. 1 is typically includes drill pipe, in other embodiments coiled tubing may be used as the conveyance mechanism (as discussed below). A pulse-generating (PG) circuit within BHA 128 may receive the electrical energy from power-conditioning unit 142 and may generate high-energy electrical pulses to drive drill bit 114. The high-energy electrical pulses may discharge through the rock formation and/or drilling fluid 122 and, in some embodiments, may provide information about the properties of the formation and/or drilling fluid 122. The PG circuit within BHA 128 may be located near drill bit 114 (e.g. downhole and in proximity to the drill bit). The PG circuit may include a power source input, including two input terminals, and a first capacitor coupled between the input terminals. The pulse generating circuit may include a first inductor coupled between the input terminals with associated opening switch and a first capacitor coupled to the two ends of the inductor. The PG circuit may also include a switch, a transformer, and a second capacitor whose terminals are coupled to respective electrodes of drill bit 114. The switch may include a mechanical switch, a solid-state switch, a magnetic switch, a gas switch, or any other type of switch suitable to open and close the electrical path between the power source input and a first winding of the transformer. The transformer can generate a current through a second winding when the switch is closed and current flows through first winding. The current through the second winding can charge the second capacitor. As the voltage across the second capacitor increases, the voltage across the electrodes of the drill bit increases. In some embodiments, the transformer may be a segmented primary transformer including multiple primary windings and a single secondary winding. In another example, the transformer may be a magnetic core transformer. The pulse generating circuit may also include a first inductor coupled between the input terminals with an associated opening switch and a second capacitor whose terminals are coupled to each end of the first inductor and to respective electrodes of drill bit 114. The first inductor may be an air core inductor or a magnetic core inductor and may generate the full voltage needed by the second capacitor for drilling. The inductor may be a segmented inductor including multiple windings with respective opening switches. Three example PG circuits are illustrated in FIGS. 3A through 3C, respectively.

The pulse-generating circuit within BHA 128 may be utilized to repeatedly apply a high electric potential, for example up to or exceeding 150 kV (e.g. approximately 150-300 kV), across the electrodes of pulsed-power drill bit 114. Each application of electric potential is referred to as a pulse. When the electric potential across the electrodes of pulsed-power drill bit 114 is increased enough during a pulse to generate a sufficiently high electric field, an electrical arc forms through a rock formation at the bottom of wellbore 116. The arc temporarily forms an electrical coupling between the electrodes of pulsed-power drill bit 114, allowing electric current to flow through the arc inside a portion of the rock formation at the bottom of wellbore 116. The arc greatly increases the temperature and pressure of the portion of the rock formation through which the arc flows and the surrounding formation and materials. The temperature and pressure are sufficiently high to break the rock itself into small bits or cuttings. This fractured rock is removed, typically by pulsed-power drilling fluid 122, which moves the fractured rock away from the electrodes and uphole. The terms "uphole" and "downhole" may be used to describe the location of various components of drilling system 100 relative to the bottom or end of wellbore 116 shown in FIG. 1. For example, a first component described as uphole from a second component may be further away from the end of wellbore 116 (e.g. closer to the surface) than the second component. Similarly, a first component described as being downhole from a second component may be located closer to the end of wellbore 116 (e.g. further from the surface) than the second component.

As pulsed-power drill bit 114 repeatedly fractures the rock formation and pulsed-power drilling fluid 122 moves the fractured rock uphole, wellbore 116, which penetrates various subterranean rock formations 118, is created and/or extended. Wellbore 116 may be any hole drilled into a subterranean formation or series of subterranean formations for the purpose of exploration or extraction of natural resources such as, for example, hydrocarbons, or for the purpose of injection of fluids such as, for example, water, wastewater, brine, or water mixed with other fluids. Additionally, wellbore 116 may be any hole drilled into a subterranean formation or series of subterranean formations for the purpose of geothermal power generation.

Although pulsed-power drill bit 114 is described above as implementing electrocrushing drilling, pulsed-power drill bit 114 may also be used for electrohydraulic drilling, rather than generating an electrical arc within the rock, drill bit 114 applies a large electrical potential across one or more electrodes and a ground ring to form an arc across the drilling fluid proximate to the downhole end of wellbore 116. The high temperature of the arc vaporizes the portion of the drilling fluid immediately surrounding the arc, which in turn generates a high-energy shock wave in the remaining fluid. The one or more electrodes of electrohydraulic drill bit may be oriented such that the shock wave generated by the arc is transmitted toward the bottom of wellbore 116. When the shock wave contacts and bounces off of the rock at the bottom of wellbore 116, the rock fractures. Accordingly, wellbore 116 may be formed in subterranean formation 118 using drill bit 114 that implements either electrocrushing or electrohydraulic drilling.

Figure 2A:
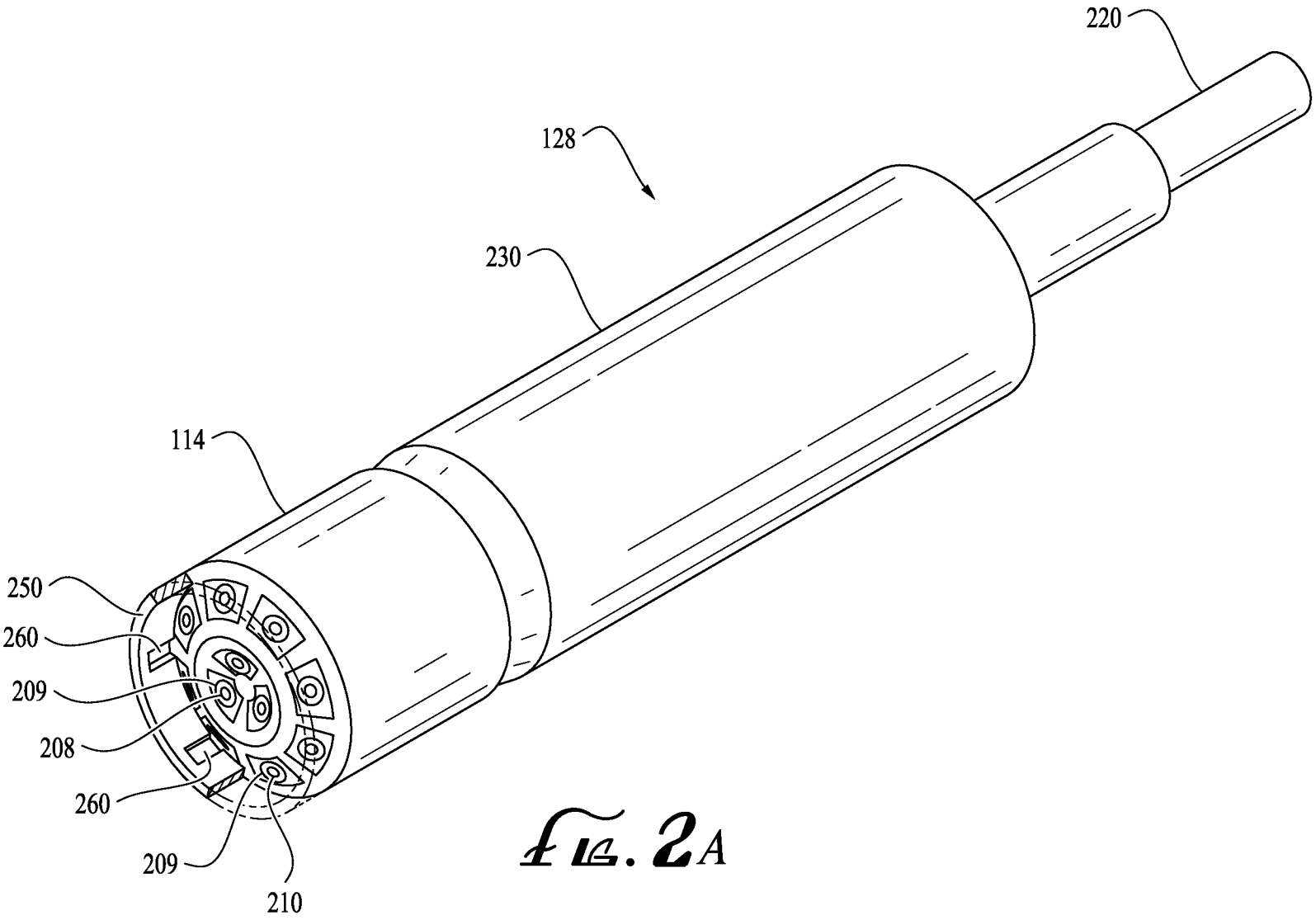
FIG. 2A is a perspective view of exemplary components of a bottom-hole assembly (BHA) for a pulsed-power drilling system, according to embodiments of this disclosure.

FIG. 2A is a perspective view of components of an exemplary bottom-hole assembly for a pulsed-power drilling system. BHA 128 may include pulsed-power tool 230 and drill bit 114. For the purposes of the present disclosure, pulsed-power drill bit 114 may be integrated within BHA 128, or may be a separate component that is coupled to BHA 128 (e.g. typically at its downhole end).

Pulsed-power tool 230 may provide pulsed electrical energy to drill bit 114. In embodiments, Pulsed-power tool 230 receives electrical power from a power source via cable 220. For example, pulsed-power tool 230 may receive electrical power via cable 220 from a power source located on the surface as described above with reference to FIG. 1. In alternate embodiments, pulsed-power tool 230 may receive electrical power from a power source located downhole such as a generator powered by a mud turbine. In still other alternate embodiments, Pulsed-power tool 230 may receive electrical power via a combination of a power source located on the surface and a power source located downhole. Drill bit 114 may include one or more electrodes 208 and 210 and ground ring 250, shown in part in FIG. 2A. Ground ring 250 may function as an electrode. Pulsed-power tool 230 converts electrical power received from the power source into pulse drilling signals in the form of high-energy electrical pulses that are applied across electrodes 208 and/or 210 and ground ring 250 of drill bit 114. Pulsed-power tool 230 may include a pulse-generating circuit as described above with reference to FIG. 1.

Referring to FIG. 1 and FIG. 2A, pulsed-power drilling fluid 122 may exit drill string 108 via openings 209 surrounding each electrode 208 and each electrode 210. The flow of pulsed-power drilling fluid 122 out of openings 209 allows electrodes 208 and 210 to be insulated by the drilling fluid. Pulsed-power drill bit 114 may include a solid insulator (not expressly shown in FIG. 1 or 2A) surrounding electrodes 208 and 210 and one or more orifices (not expressly shown in FIG. 1 or 2A) on the face of pulsed-power drill bit 114 through which pulsed-power drilling fluid 122 exits drill string 108. Such orifices may be simple holes, or they may be nozzles or other shaped features. Because fines are not typically generated during pulsed-power drilling, as opposed to mechanical drilling, pulsed-power drilling fluid 122 may not need to exit the drill bit at as high a pressure as the drilling fluid in mechanical drilling. As a result, nozzles and other features used to increase drilling fluid pressure may not be needed. However, nozzles or other features to increase pulsed-power drilling fluid 122 pressure or to direct pulsed-power drilling fluid may be included for some uses.

Pulsed-power drilling fluid 122 (e.g. drilling mud) is typically circulated through drilling system 100 at a flow rate sufficient to remove fractured rock from the vicinity of pulsed-power drill bit 114 (e.g. moving the fractured rock material uphole). In addition, pulsed-power drilling fluid 122 may be under sufficient pressure at a location in wellbore 116, particularly a location near a hydrocarbon, gas, water, or other deposit, to prevent a blowout.

In addition, pulsed-power drill bit 114 may include ground ring 250, shown in part in FIG. 2A. Ground ring 250 may function as an electrode. Although illustrated as a contiguous ring in FIG. 2A, ground ring 250 may be non-contiguous discrete electrodes and/or implemented in different shapes. Electrodes 208 and 210 may be at least 0.4 inches (i.e., at least approximately 10 millimeters) apart from ground ring 250 at their closest spacing, at least 1 inch apart at their closest spacing, at least 1.5 inches (i.e., at least approximately 38 millimeters) apart at their closest spacing, or at least 2 inches (i.e., at least approximately 51 millimeters) apart at their closest spacing.

If drilling system 100 experiences vaporization bubbles in pulsed-power drilling fluid 122 near pulsed-power drill bit 114, the vaporization bubbles may have deleterious effects. For instance, vaporization bubbles near electrodes 208 or 210 may impede formation of the arc in the rock. Pulsed-power drilling fluid 122 may be circulated at a flow rate also sufficient to remove vaporization bubbles from the vicinity of electrocrushing drill bit 114. Although not all pulsed-power drill bits 114 may have ground ring 250, if it is present, it may contain passages 260 to permit the flow of electrocrushing drilling fluid 122 along with any fractured rock or bubbles away from electrodes 208 and 210 and uphole.

Figure 2B:
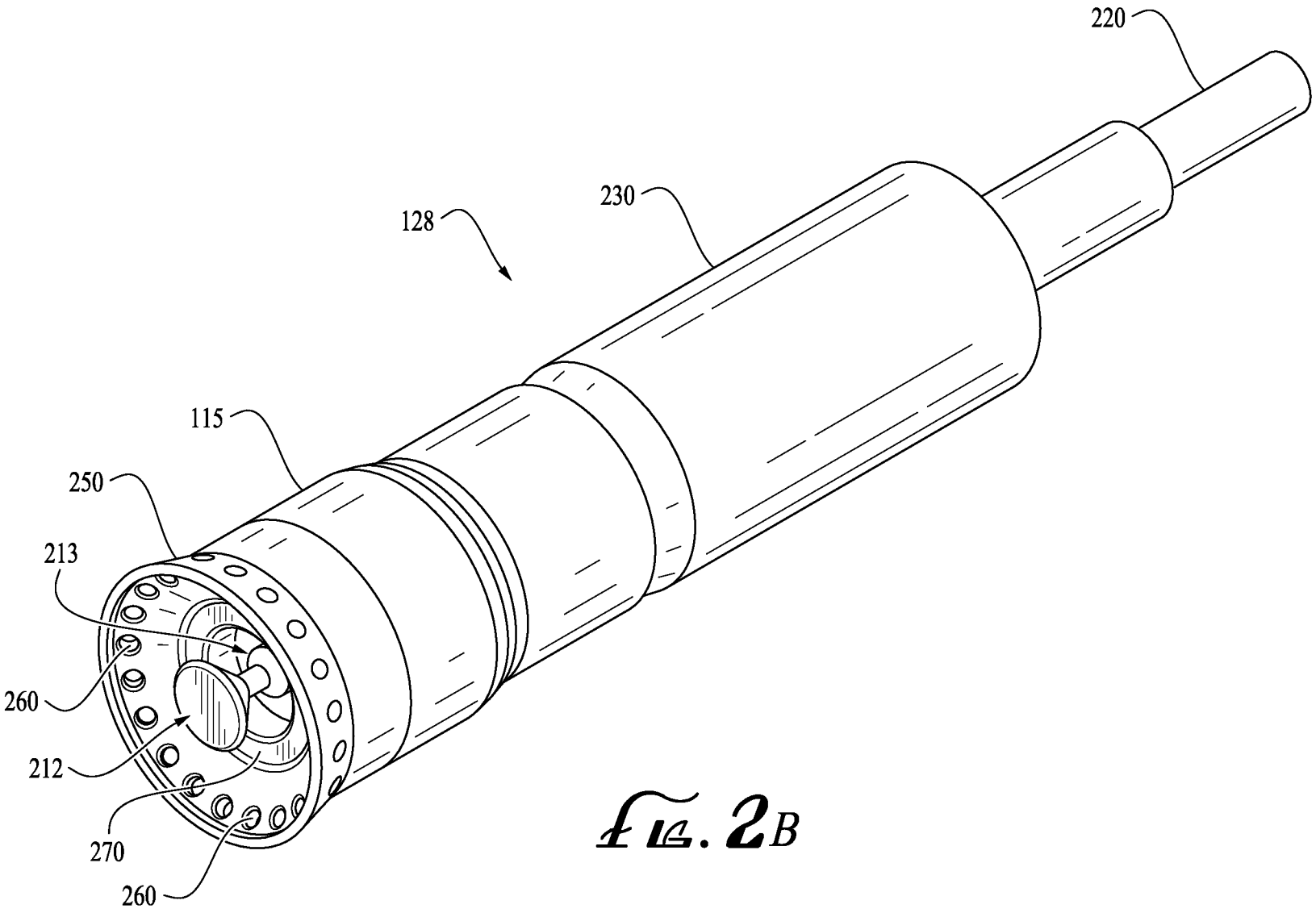
FIG. 2B is a perspective view of exemplary components of an alternative bottom-hole assembly for a pulsed-power drilling system, according to embodiments of this disclosure.

FIG. 2B is a perspective view of another exemplary components of a bottom-hole assembly for downhole pulsed-power drilling system 100. BHA 128 may include pulsed-power tool 230 and drill bit 114. For the purposes of the present disclosure, drill bit 114 maybe integrated within BHA 128, or may be a separate component that is coupled to BHA 128. BHA and pulsed-power tool 230 may include features and functionalities discussed above in FIG. 2A. For example, pulsed-power drilling fluid 122 may exit drill string 108 via opening 213 surrounding electrode 212. The flow of pulsed-power drill fluid 122 out of opening 213 allows electrode 212 to be insulated by the pulsed-power drilling fluid. While one electrode 212 is shown in FIG. 2B, pulsed-power drill bit 114 may include multiple electrodes 212. Pulsed-power drill bit 114 may include solid insulator 210 surrounding electrode 212 and one or more orifices (not expressly shown in FIG. 2B) on the face of pulsed-power drill bit 114 through which pulsed-power drilling fluid 122 exits drill string 108. Nozzles or other features to increase pulsed-power drilling fluid 122 pressure or to direct pulsed-power drilling fluid may be included for some uses. Additionally, the shape of solid insulator 210 may be selected to enhance the flow of pulsed-power drilling fluid 122 around the components of pulsed-power drill bit 114.

Pulsed-power drill bit 114 may include bit body 115, electrode 212, ground ring 250, and solid insulator 210. Electrode 212 may be placed approximately in the center of pulsed-power drill bit 114. Electrode 212 may be positioned at a minimum distance from ground ring 250 of approximately 0.4 inches and at a maximum distance from ground ring 250 of approximately 4 inches. The distance between electrode 212 and ground ring 250 may be based on the parameters of the pulsed drilling operation and/or on the dimeter of drill bit 114. For example, the distance between electrode 212 and ground ring 250, at their closest spacing, may be at least 0.4 inches, at least 1 inch, at least 1.5 inches, or at least 2 inches. The distance between electrode 212 and ground ring 250 may be generally symmetrical or may be asymmetrical such that the electric field surrounding the pulsed-power drill bit 114 has a symmetrical or asymmetrical shape. The distance between electrode 212 and ground ring 250 allows pulsed-power drilling fluid 122 to flow between electrode 212 and ground ring 250 to remove vaporization bubbles from the drilling area.

Electrode 212 may have any suitable diameter based on the drilling operation, on the distance between electrode 212 and ground ring 250, and/or on the dimeter of drill bit 114. For example, electrode 212 may have a diameter between approximately two and approximately ten inches (i.e., between approximately 51 and approximately 254 millimeters).

Ground ring 250 may function as an electrode and provide a location on the pulsed-power drill bit where an arc may initiate and/or terminate. Drill bit 114 may also include one or more fluid flow ports 260 on the face of the drill bit through which drilling fluid exits the drill string 108. For example, ground ring 250 of drill bit 114 may include one or more fluid flow ports 260 such that pulsed-power drilling fluid 122 flow through fluid flow ports 260 carry fractured rock and vaporization bubbles away from the drilling area. Fluid flow ports 260 may be simple holes, or they may be nozzles or other shaped features. Drilling fluid 122 is typically circulated through drilling system 100 at a flow rate sufficient to remove fractured rock from the vicinity of drill bit 114. In addition, drilling fluid 122 may be under sufficient pressure at a location in wellbore 116, particularly a location near a hydrocarbon, gas, water, or other deposit, to prevent a blowout. Drilling fluid 122 may exit drill string 108 via opening 213 surrounding electrode 212. The flow of drilling fluid 122 out of opening 213 allows electrode 212 to be insulated by the drilling fluid. Because fines are not typically generated during pulsed-power drilling, as opposed to mechanical drilling, drilling fluid 122 may not need to exit the drill bit at as high a pressure as the drilling fluid in mechanical drilling. As a result, nozzles and other features used to increase drilling fluid pressure may not be needed on drill bit 114. However, nozzles or other features to increase drilling fluid 122 pressure or to direct drilling fluid may be included for some uses. Additionally, the shape of solid insulator 20 may be selected to enhance the flow of drilling fluid 122 around the components of drill bit 114.

As described above with reference to FIGS. 1, 2A, and 2B, when the electric potential across electrodes of a pulsed-power drill bit becomes sufficiently large, an electrical arc forms through the rock formation and/or drilling fluid that is near the electrodes. The arc provides a temporary electrical short between the electrodes, and thus allows electric current to flow through the arc inside a portion of the rock formation and/or drilling fluid at the bottom of the wellbore. The arc increases the temperature of the portion of the rock formation through which the arc flows and the surrounding formation and materials. The temperature is sufficiently high to vaporize any water or other fluids that might be proximate to the arc and may also vaporize part of the rock itself. The vaporization process creates a high-pressure gas which expands and, in turn, fractures the surrounding rock.

Pulsed-power drilling systems and pulsed-power tools may utilize any suitable pulse-generating (PG) circuit topology to generate and apply high-energy electrical pulses across electrodes within the pulsed-power drill bit. Such pulse-generating circuit topologies may utilize electrical resonance to generate the high-energy electrical pulses required for pulsed-power drilling. The pulse-generating circuit may be shaped and sized to fit within the circular cross-section of pulsed-power tool 230, which as described above with reference to FIGS. 2A and 2B, may form part of BHA 128. The pulse-generating circuit may be enclosed within an encapsulant, such a thermally conductive material that protects the pulse-generating circuit from the wide range of temperatures (for example, from approximately 10 to approximately 200 degrees Centigrade) within the wellbore.

The pulsed-power drilling systems described herein may generate multiple electrical arcs per second using a specified excitation current profile that causes a transient electrical arc to form and arc through the most conducting portion of the wellbore floor. As described above, the arc causes that portion of the wellbore floor to disintegrate or fragment and be swept away by the flow of drilling fluid. As the most conductive portions of the wellbore floor are removed, subsequent electrical arcs may naturally seek the next most conductive portion. Therefore, obtaining measurements from which estimates of the excitation direction can be generated may provide information usable in determining characteristics of the formation.

The electrical pulses used for electrocrushing drilling may be generated using any of a variety of PG circuits including, but not limited to, circuits that include capacitive energy storage elements and circuits that include inductive energy storage elements. FIGS. 3A through 3C illustrate three non-limiting examples of PG circuits.

Pulse-Generating (PG) circuit 300, illustrated in FIG. 3A, is configured to store electrical energy in a primary capacitor C1 (320) charged by an alternator (310) through an isolation switch S1 (312). When the appropriate voltage has been reached on primary capacitor C1 (320), that energy is switched by electrical switch S2 (314) into a pulse transformer (350) to step up the voltage and charge an output capacitor CO (330). The rising voltage on output capacitor CO (330), which is coupled to a drill bit (340), creates the electrical arc that fractures the rock. In this example, PG circuit 300 uses capacitive energy storage.

PG circuit 302, illustrated in FIG. 3B, is configured to use an inductor for charging the primary capacitor C1 (320), which in turn is switched to the transformer (350) to charge a secondary capacitor, shown as output capacitor CO (330). In this example, current runs from the alternator (310) through an isolation and opening switch S3 (316) through an inductor L1 (322) to store energy in the magnetic field. When that current is interrupted by opening switch S3 (316), a large voltage is created across inductor L1 (322). This example PG circuit 302 uses an opening switch S3 (316) that first closes to connect inductor L1 (322) to the alternator (310), or another power source, and then on command opens to interrupt that current flow, creating a voltage across inductor L1 (322). In this example, opening switches such as S3 (316) may need to be capable of high-voltage standoff. The voltage pulse from inductor L1 (322) charges primary capacitor C1 (320), which is then switched into the transformer (350) via switch S2 (314). The rising voltage on output capacitor CO (330), which is coupled to a drill bit (340), creates the electrical arc that fractures the rock. In this example, PG circuit 302, inductor L1 (322) and opening switch S3 (316) may be used to step up the voltage output from the alternator (310). In this example, PG circuit 302 uses inductive energy storage.

PG circuit 304, illustrated in FIG. 3C, is configured to use the voltage output from an inductor L2 (332) to directly charge a secondary capacitor, shown as output capacitor CO (330, eliminating the transformer. The rising voltage on output capacitor CO (330), which is coupled to a drill bit (340), creates the electrical arc that fractures the rock. The high voltage requirements for the corresponding opening switch, shown as S4 (318), may be significant.

In some embodiments, one or more sensors may be located in the wellbore, for example disposed on or in the BHA. In embodiments, the sensors may be configured to transmit measured sensor data to the surface. For example, a communication and/or fiber-optic cable (as discussed below, for example with reference to FIG. 5) may communicatively couple the one or more downhole sensors to the surface (e.g. to a processor and/or controller on the surface).

For example, the downhole sensors, which may include any number of sensors of any suitable type, may be part of a measurement system. In some embodiments, the measurement system (with downhole sensors) may be configured for example to detect, receive, and/or measure an electric and/or magnetic field. In embodiments, the sensors may include any type of sensor that records responses from electromagnetic and/or acoustic waves. In embodiments, the downhole sensors of the measurement system may include one or more (or in some instances, an array) of acoustic sensors which may be used within the wellbore. For example, the acoustic sensors may be positioned at different locations within the wellbore and/or may be oriented in different directions to record responses to propagating acoustic waves. The acoustic sensors may be configured to provide information about the surrounding formation at various depths, which may be used to form a three-dimensional image of the surrounding subterranean features in some embodiments. In some embodiments, the sensors may be integrated in the pulsed-power tool 230 or may be separate sensors within the BHA 128, such as within a measurement while drilling (MWD) system.

Some embodiments may include a processing unit, which may be coupled to one or more input/output interfaces and/or data storage, for example over an interconnect. An exemplary interconnect may be implemented using any suitable computing system interconnect mechanism or protocol. Some embodiments of the processing unit may be configured to determine characteristics of a formation ahead of the drilling tool based, at least in part, on inputs received by input/output interfaces, some of which may include measurements representing responses recorded by various sensors within the wellbore, such as voltages, currents, ratios of voltages to current, electric field strengths or magnetic field strengths. For example, processing unit may be configured to perform one or more inversions based on simulation models that relate the electromagnetic properties of the formation to electromagnetic data collected by downhole sensors and/or relate the acoustic properties of the formation to acoustic data collected by downhole sensors. In some embodiments, the processing unit (which may serve as a controller for the pulsed-power drilling system 100 in some embodiments) may be disposed at the surface.

The processing unit may include a processor, that is any system, device, or apparatus configured to interpret and/or execute program instructions and/or process. For example, the processor may be or include, without limitation, a microprocessor, microcontroller, digital signal processor (DSP), application specific integrated circuit (ASIC), or any other digital or analog circuitry configured to interpret and/or execute program instructions and/or process data. In some cases, the processor may interpret and/or execute program instructions and/or process data stored in one or more computer-readable media included in the processing unit.

In some embodiments, computer-readable media may be communicatively coupled to the processor and may include any system, device, or apparatus configured to retain program instructions and/or data for a period of time (e.g., computer-readable media). Computer-readable media may include random access memory (RAM), read-only memory (ROM), solid state memory, electrically erasable programmable read-only memory (EEPROM), disk-based memory, a PCMCIA card, flash memory, magnetic storage, opto-magnetic storage, or any suitable selection and/or array of volatile or non-volatile memory that retains data after power to the processing unit is turned off. For example, computer-readable media may include instructions for determining one or more characteristics of formation based on signals received from various acoustic, electrical or electromagnetic sensors by input/output interfaces, logging data, or characteristics of cuttings.

In some embodiments, input/output interfaces may be coupled to an optical fiber (e.g. a fiber optic cable), such as an optical fiber element of telemetry mechanism, over which it may send and receive signals. Signals received by input/output interfaces may include measurements representing responses recorded by various sensors at the surface or downhole during a pulsed-drilling operation. For example, signals received by input/output interfaces may include measurements representing responses recorded by various acoustic, electrical or electromagnetic sensors. These measurements may include, without limitation, measurements of voltage, current, electric field strength, or magnetic field strength. In embodiments, these and other inputs may be received using communication interfaces or telemetry mechanisms other than an optical fiber including, but not limited to, mechanisms for receiving acoustic, electric or electromagnetics signals, and various mechanical telemetry methods.

In some embodiments, control signals relating to the pulsed-power drilling system 100 may be communicated to one or more electrical or mechanical components located downhole via input/output interfaces using any suitable communication protocol interfaces or telemetry mechanisms. For example, a control signal may be sent electrically over a power cable (e.g., over surface cable 143 illustrated in FIG. 1 and a sub-surface cable, or over cable 220 illustrated in FIG. 2A or 2B) or over a separate control cable, via an optical fiber (e.g. a fiber optic cable), a wireline or a wired pipe, or via acoustic, mud pulse, or electromagnetic telemetry. In some cases, an electrical or mechanical control signal may be communicated directly to a configurable electrical or mechanical component downhole that is to be adjusted. In other cases, when the control signal does not convey actuation energy, the control signal may be communicated to an intermediate downhole component that receives the control signal and translates it. In one example, the intermediate downhole component may engage a power supply for the actuation, such as a battery, a generator power, or power received from the surface over a cable that is switched on, in a controlled manner. In another example, the intermediate downhole component may include a downhole electrical actuator or a downhole mechanical actuator. While control signals may be used to operate any number of downhole tool elements (e.g. associated with the pulsed-power drilling system), in some embodiments the control signals may be useful in steering the pulsed-power drilling system as it forms the wellbore.

For example, the tool string/drill string 108 (e.g. of the pulsed-power drilling system and or BHA) may be configured to be steerable, for example as a rotary steerable tool. In some embodiments, this may provide full three-dimensional (3D) directional control of the drill bit. In some embodiments, the tool string may include one or more logging while drilling (LWD) or measurement-while-drilling (MWD) tools that collect measurements relating to various borehole and formation properties as well as the position of the drill bit and various other drilling conditions as the drill bit extends the borehole of the wellbore through the formations. For example, the LWD/MWD tool may include a device for measuring formation resistivity, a gamma ray device for measuring formation gamma ray intensity, devices for measuring the inclination and azimuth of the tool string, pressure sensors for measuring fluid pressure, temperature sensors for measuring borehole temperature, or any other downhole tool or combination thereof.

In some embodiments, the tool string 108 may also be configured for telemetry (e.g. by including a telemetry module). For example, the telemetry module may receive data provided by the various sensors of the tool string 108 (for example, sensors of the LWD/MWD tool), and transmit the data to a surface control unit (which may be a processing unit as described herein). Data may also be provided by the surface control unit, received by the telemetry module, and transmitted to the tools (for example, LWD/MWD tool, rotary steering tool, pulsed-power drill bit, or any other tool) of the tool string 108. In one or more embodiments, fiber optic telemetry, mud pulse telemetry, wired drill pipe, acoustic telemetry, or other telemetry technologies known in the art may be used to provide communication between the surface control unit and the telemetry module. In one or more embodiments, the surface control unit may communicate directly with the LWD/MWD tool, the rotary steering tool or both. In embodiments, the surface control unit may be stationed at the well site, a portable electronic device, a remote computer, or distributed between multiple locations and devices. The surface control unit may also be a control unit that controls functions of equipment of the tool string.

Steering systems may, for example, allow the well's trajectory to be corrected or altered in response to the measurements taken by the sensors. For example, the steering system can be configured to change the direction of the tool string, the drill bit or both, such as based on information indicative of tool orientation and a desired drilling direction and/or operation of an extendable member assembly. In one or more embodiments, an exemplary extendable member assembly may comprise an extendable member and an extendable member diagnostic assembly. In one or more embodiments, the steering system may be coupled to the drill bit and drive rotation of the drill bit. In one or more embodiments, the steering system (e.g. rotary steerable tool) can rotate in tandem with the drill bit. In one or more embodiments, the rotary steerable tool may be a point-the-bit system or a push-the-bit system. In embodiments, the steering system may comprise one or more sensors for making any measurement, including measurement while drilling data, logging while drilling data, formation evaluation data, temperature, pressure, velocity, speed, any other downhole data or any combination thereof.

As previously described, the conveyance mechanism for the pulsed-power drill bit 114 (e.g. within a tool string and/or BHA) can be coiled tubing in some embodiments. Generally speaking, coiled tubing is relatively flexible continuous tubing that can be run into the wellbore from a large spool mounted on a truck or other support structure. For example, the spool typically has an axle, allowing rotation of the spool thereabout. While a rig using drilling pipe must stop periodically to make up or break down connections when running drilling pipe into or out of the wellbore, coiled tubing can be run in for substantial lengths before stopping to join in another strand of coiled tubing, thereby saving time with reference to jointed pipe. Furthermore, coiled tubing may provide improved steering maneuverability, for example due to its flexibility.

Figure 4:
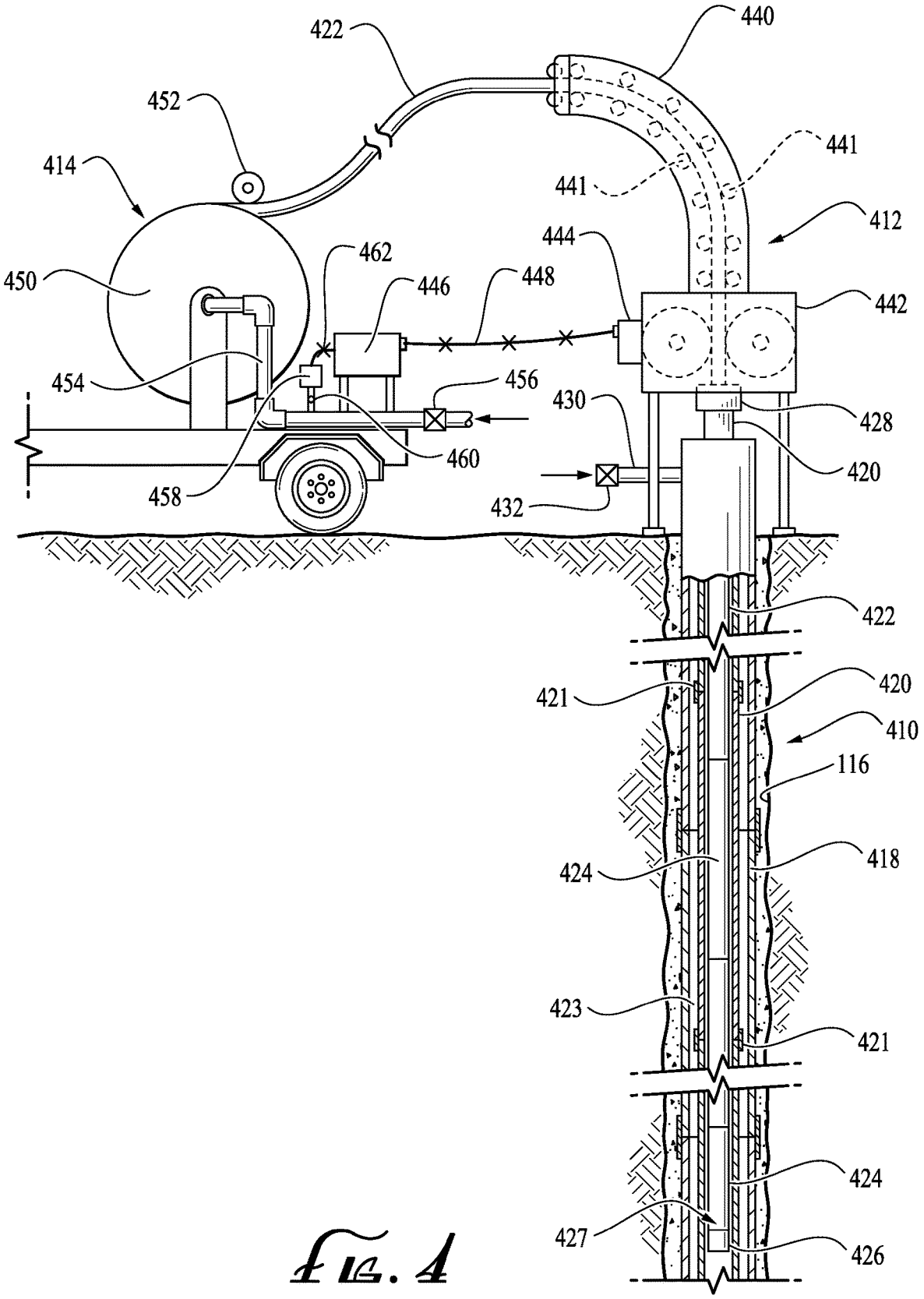
FIG. 4 illustrates an elevation view of an exemplary coiled tubing system, according to embodiments of this disclosure.

FIG. 4 illustrates an exemplary system for deploying coiled tubing 422 downhole. Coiled tubing 422, which typically is relatively small and flexible tubing, is normally stored on a reel or spool 450 when not in use. FIG. 4 relates to a generic coiled tubing system, and illustrates generic coiled tubing 422. However, similar systems may be used with pulsed-power coiled tubing of the sort described herein and shown, for example, in FIGS. 5-7B. Exemplary coiled tubing 422 may be formed of steels having yield strengths ranging from 55,000 PSI to 120,000 PSI or of composite materials (e.g. having sufficient mechanical strength to support its own weight plus the weight of the drill string, sufficient flexibility to be coiled on a spool or reel 450, and other physical properties (e.g. chemical and abrasion resistance) enabling use in a wellbore in association with downhole operations). Coiled tubing 422 may be available in diameters of 0.75 to 4.5 inches, 1 to 3.5 inches, approximately 4.5 inches, or approximately 2 inches, and may range in length from 2,000 to more than 30,000 ft (e.g. 600 to 9,000 m). Often, coiled tubing 422 is coiled in a single continuous length, thus precluding any need for making or breaking connections between joints, although embodiments may include coiled tubing 422 which is formed by connecting two or more coiled tubing elements/segments (e.g. from two or more spools of coiled tubing) end-to-end (e.g. serially).

In operation, the coiled tubing 422 may be passed through an injector mechanism 412, and a tool string (e.g. drill string 108) may be connected to the end of the coiled tubing 422 (e.g. the downhole end). For example, the tool string/drill string 108 may comprise one or more downhole tools (which may include the pulsed-power drill bit 114 in some embodiments) joined together by any convenient means known to those skilled in the art. The injector mechanism 412 may be configured to pull the tubing from the spool 450, straighten the tubing, and then inject the tubing downhole, for example through a seal assembly at the wellhead known as a "stuffing box." The injector mechanism 412 may be capable of injecting thousands of feet of coiled tubing 422 with the tool string connected at the bottom end thereof into the well. In embodiments, the coiled tubing 422 may be supported by a gooseneck coupled to a mast or other supporting structure.

A fluid, most often a liquid such as salt water, brine, mud or a hydrocarbon liquid, can be circulated through the coiled tubing 422 for operating the downhole tool(s) or for other purposes. For example, drilling mud (e.g. drilling fluid) may be pumped downhole through the coiled tubing 422, with the mud exiting through the pulsed-power drill bit 114 (e.g. as described herein) and then circulating uphole to remove fractured rock from the vicinity of the pulsed-power drill bit 114. The coiled tubing injector at the surface can be used to raise and lower the coiled tubing and the tool string 108 (e.g. during drilling) and to remove the coiled tubing 422 and tool string 108 as the tubing is rewound on the spool 450 at the end of the drilling procedure.

The exemplary coiled tubing injector mechanism 412 is of a design known to those skilled in the art. Coiled tubing injector 412 is configured to straighten the coiled tubing 422 (e.g. as it is pulled off of the spool 450) and inject it into well 410, for example by way of stuffing box 428. In FIG. 4, coiled tubing injector 412 comprises a straightening mechanism 440 having a plurality of internal guide rollers 441 therein and a coiled tubing drive mechanism 442 for inserting the coiled tubing 422 into the well, raising it or lowering it within the well, and removing it from the well as it is rewound on a spool 450. A depth measuring device 444 may be connected to the coiled tubing drive mechanism 442 in some embodiments. For example, measuring device 444 may continuously measure the length of coiled tubing 422 injected into the well 410 and provide that information by way of an electric transducer (not shown) and an electric cable 448 to an electronic data acquisition system 446.

In some embodiments, the spool 450 of coiled tubing 422 may be mounted on a truck for ease of transport. For example, a truck mounted spool assembly 414 can include spool 450 for containing coils of the coiled tubing 422. A guide wheel 452 for guiding the coiled tubing 422 on and off spool 450 may also be provided, and a conduit assembly 454 may be connected to the end of coiled tubing 422 on spool 450 by way of a swivel system (not shown).

In embodiments, a coiled tubing conveyance system (similar to that described above) may be used to convey a pulsed-power drill downhole. By integrating a pulsed-power drilling system 100 with a coiled tubing conveyance system (as shown in FIG. 4, for example), improved pulsed-power drilling may be possible. As discussed in FIG. 5 below, an exemplary coiled tubing pulsed-power drilling system 505 can be configured to simultaneously provide power and drilling fluid downhole to the drill string/tool string 108, for example without the need for downhole power generation.

Figure 5:
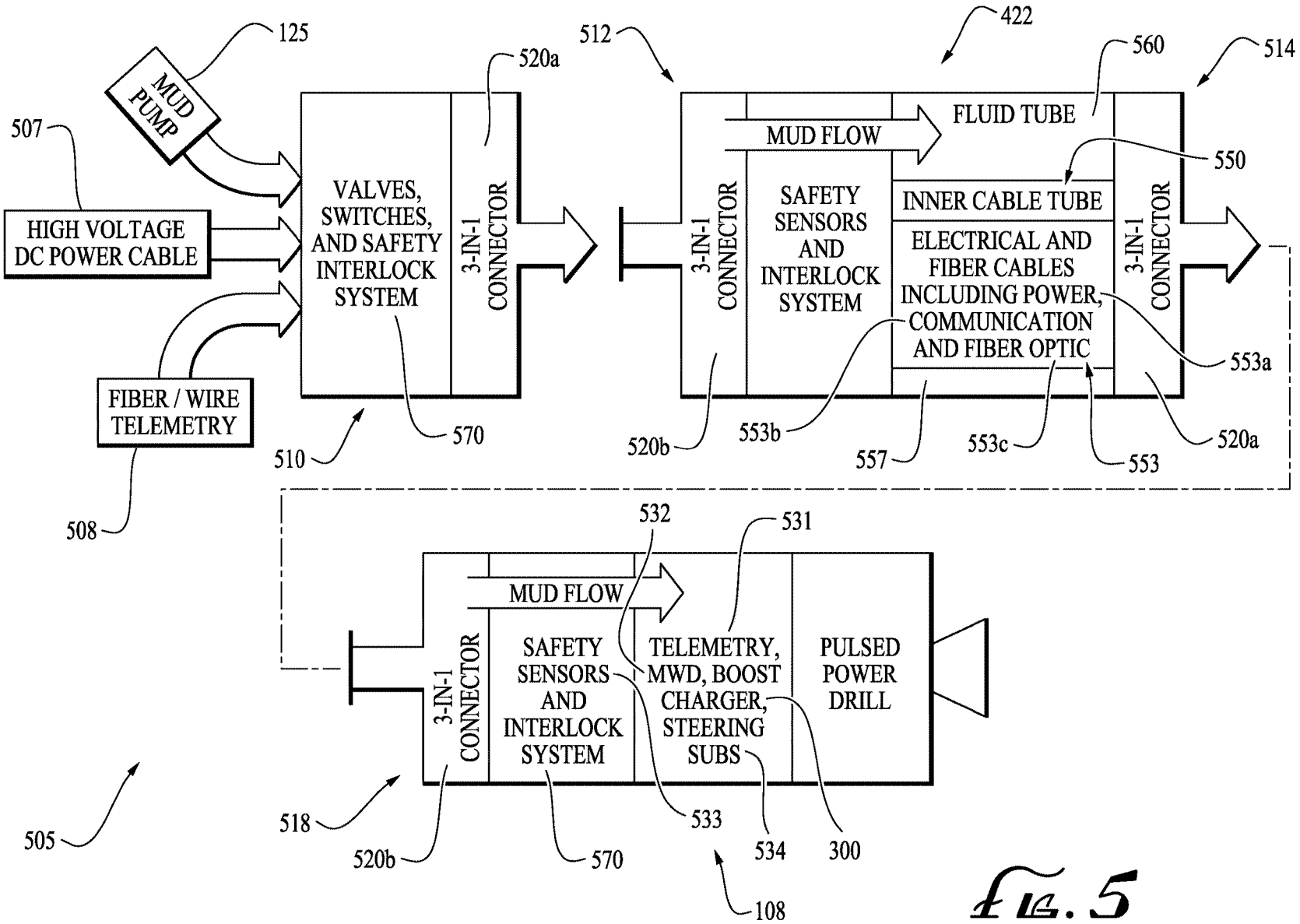
FIG. 5 illustrates schematically an exemplary coiled tubing pulsed-power drilling system, according to embodiments of this disclosure.
Figure 6A:
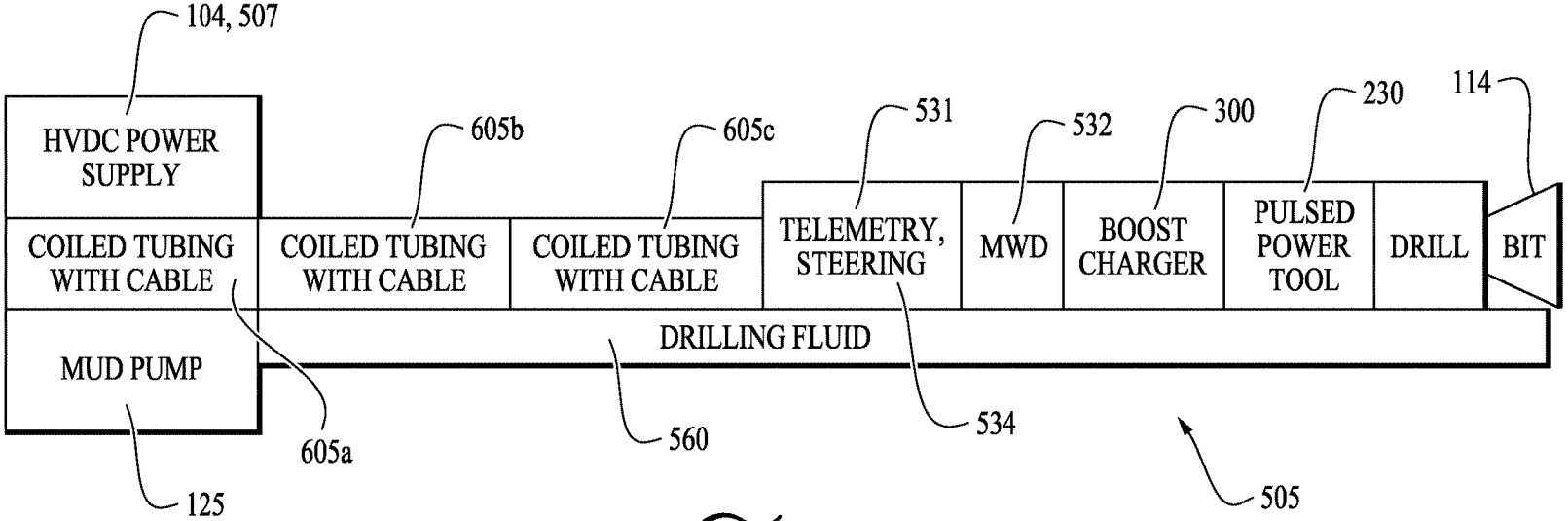
FIG. 6A illustrates schematically exemplary components of an exemplary coiled tubing pulsed-power drilling system, according to embodiments of this disclosure.
Figure 6B:
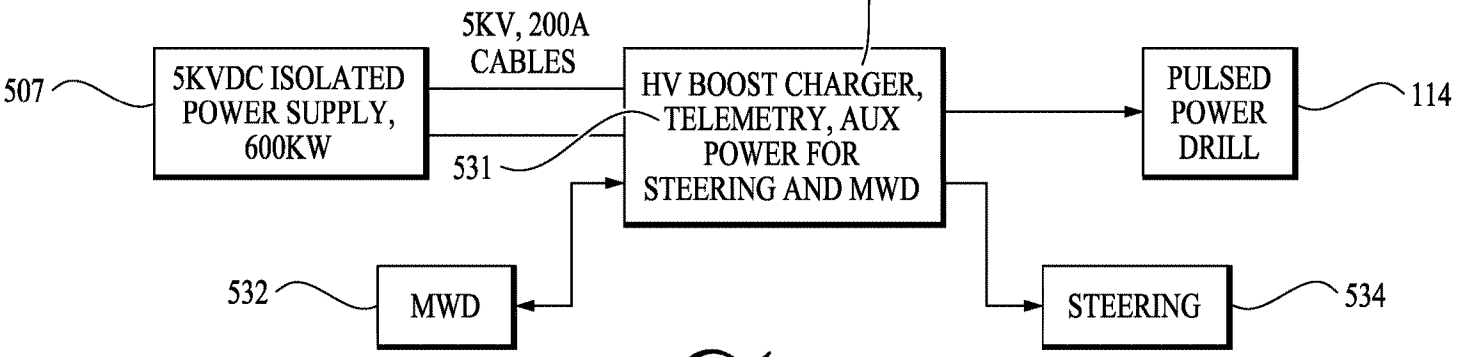
FIG. 6B illustrates schematically a block diagram of exemplary interaction of components of an exemplary coiled tubing pulsed-power drilling system, according to embodiments of this disclosure.

FIG. 5 illustrates schematically an exemplary system 505 in which a tool string (e.g. drill string 108) having a pulsed-power drill bit 114 is conveyed downhole in a wellbore and operated via coiled tubing 422. FIG. 6A illustrates schematically exemplary components of an exemplary coiled tubing pulsed-power drilling system 505, while FIG. 6B illustrates schematically a block diagram of exemplary interaction of components of an exemplary coiled tubing pulsed-power drilling system 505, according to embodiments of this disclosure. Exemplary pulsed-power drilling systems 505 will be discussed in detail with reference to these figures.

For example, a pulsed-power drilling system 505 may include coiled tubing 422, a coiled tubing input interface subsystem 510 disposed at the surface, and a tool string 108 (which may have a pulsed-power drill bit 114). The coiled tubing 422 of the exemplary systems in FIGS. 5 and 6A may be configured to allow simultaneous transmission of power and drilling fluid downhole, for example using a cable tube 550 within a fluid tube 560 as will be discussed in greater detail with respect to FIGS. 7A and 7B. In some embodiments, the cable tube 550 may comprise one or more cables 553 disposed within protective tubing 557. In FIG. 5, an uphole end 512 of the coiled tubing 422 may be configured to connect or couple to the coiled tubing input interface subsystem 510 (e.g. to provide hydraulic connection for the fluid tube 560, electrical connection of for the power cable of the cable tube 550, and/or electrical and/or fiber optic connection for the telemetry/communication of the cable tube 550). In FIG. 5, the coiled tubing input interface subsystem 510 is shown as having a 3-in-1 connector 520*a*, which may be configured for input (e.g. from mud pump 125, a high voltage DC power cable 507, which may provide power from a generator 140 or other surface power source, and fiber/wire telemetry 508) and distribution of drilling fluid (e.g. drilling mud), power, and fiber/wire telemetry to the coiled tubing 422. In some embodiments, the coiled tubing input interface subsystem 510 may also include one or more valves and/or switches. Similarly, a downhole end 514 of the coiled tubing 422 may be configured to connect or couple to a distribution subsystem 518 of the tool string 108 (e.g. to provide hydraulic connection for the fluid tube 560, electrical connection of for the power cable of the cable tube 550, and/or electrical and/or fiber optic connection for the telemetry/communication of the cable tube 550). In FIG. 5, the distribution subsystem 518 of the tool string 108 is shown as comprising a 3-in-1 connector 520*b*, which may be configured for input from the coiled tubing 422 and distribution of drilling fluid (e.g. drilling mud), power, and fiber/wire telemetry to the tool string 108, for example as it is deployed downhole in a wellbore. The tool string 108 is disposed (e.g. coupled) at the downhole end 514 of the coiled tubing 422, and the coiled tubing input interface subsystem 510 is disposed (e.g. coupled) at the uphole end 512 of the coiled tubing 422, as shown in FIG. 5. In FIG. 5, the coiled tubing 422 has mating 3-in-1 connectors 520 *a, b* at the uphole end 512 and the downhole end 514 (e.g. with the uphole end 3-in-1 connector 520 *b* of the coiled tubing 422 configured to mate with the 3-in-1 connector 520*a* of the coiled tubing input interface subsystem 510, and with the downhole end 3-in-1 connector 520*a* of the coiled tubing 422 configured to mate with the distribution subsystem 518 of the tool string 108). These and other connections will be discussed in more detail below, for example with regard to FIGS. 8A-E.

In embodiments, power and drilling fluid may simultaneously flow from the coiled tubing input interface subsystem 510 to the tool string 108 via the coiled tubing 422. In use, the coiled tubing 422 extends downhole in a wellbore. In embodiments, the tool string 108 comprises a pulsed-power drill bit 114, and may further comprise, for example in a BHA 128, elements for telemetry 531, MWD 532, power boosting (e.g. using a pulse generating circuit, e.g. 300, 302, 304), sensing (e.g. sensors 533), and/or steering 534, as shown in FIGS. 5-6B for example. In some embodiments, the coiled tubing 422 may comprise two or more coiled tubing elements/segments (e.g. 605 *a, b, c*) coupled end-to-end (e.g. in series) to allow fluid flow and power transmission therethrough from an uphole end 512 of a first coiled tubing element to a downhole end 514 of a second coiled tubing element (for example as shown in FIG. 6A). Each coiled tubing element 605 may comprise a fluid tubing element and a cable conduit/tube element, for example so that jointly the coupled coiled tubing elements may effectively transmit drilling fluid and power downhole.

In embodiments, the system 505 may include a generator 140 or other power source configured to provide power (e.g. through high voltage DC power cable 507) to the power cable 553*a* of the coiled tubing 422 via the coiled tubing input interface subsystem 510. In embodiments, there may be no power generation downhole, with all power for the pulsed-power drill bit 114 and/or pulse-generating circuit 300, 302, 304 being transmitted downhole via the coiled tubing 422. As shown in FIG. 6A, the generator 140 or power source may be a high-voltage DC power supply 507, which may provide approximately 5 kV DC power supply and/or 600 W, and/or the power cable 552*a* may transmit approximately 5 kV and 200A downhole, in some embodiments. In embodiments, the system 505 may further comprise a mud pump 125 configured to provide drilling fluid to the fluid tube 560 of the coiled tubing 422 via the coiled tubing input interface subsystem 510 (as shown in FIG. 5) and/or to pump the drilling fluid downhole to the tool string 108 through the fluid tube 560 of the coiled tubing 422. Some embodiments may further comprise a safety interlock system 570, which may be configured to provide and/or detect secure connections (e.g. of the fluid tube 560, the power cable, etc.). In embodiments, the safety interlock system 570 may be disposed within the coiled tubing input interface subsystem 510, the tool string 108 (e.g. the tool string distribution subsystem 518), and/or the coiled tubing 422 (e.g. the connector). See for example, FIG. 5.

In embodiments, the drilling fluid (e.g. mud) pumped downhole may comprise dielectric drilling fluid, which may be particularly useful in the context of pulsed-power drilling. System embodiments may further include a spool 450 (e.g. similar to that shown in FIG. 4), with at least a portion of the coiled tubing 422 disposed on the spool 450. For example, the coiled tubing 422 of the present disclosure may be transported to the drill site on a spool 450. The coiled tubing 422 may be unwound from the spool 450 as it is fed downhole, and may be re-wound onto the spool 450 as it is retracted/removed from the wellbore.

Figure 7A:
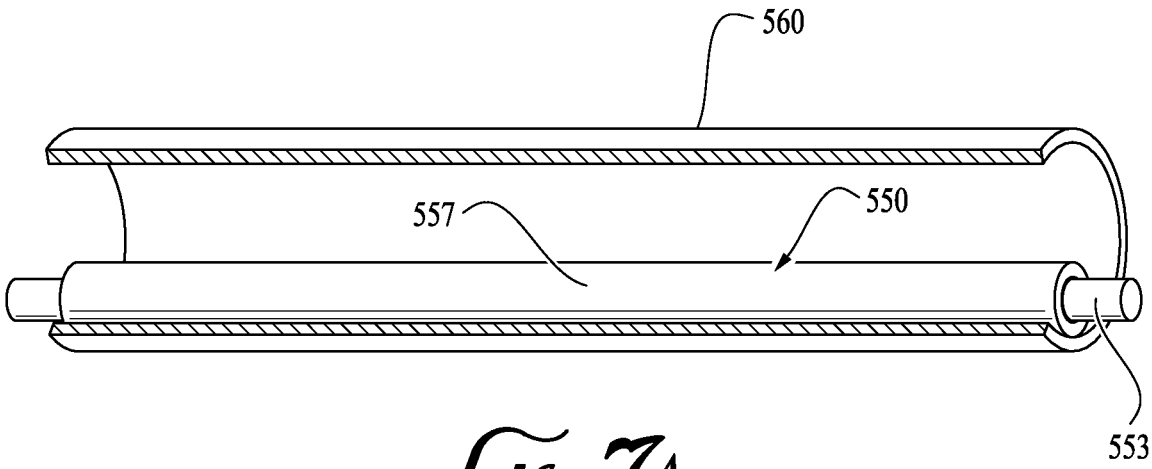
FIG. 7A illustrates a longitudinally sectioned elevation view of an exemplary coiled tubing embodiment, according to embodiments of this disclosure.
Figure 7B:
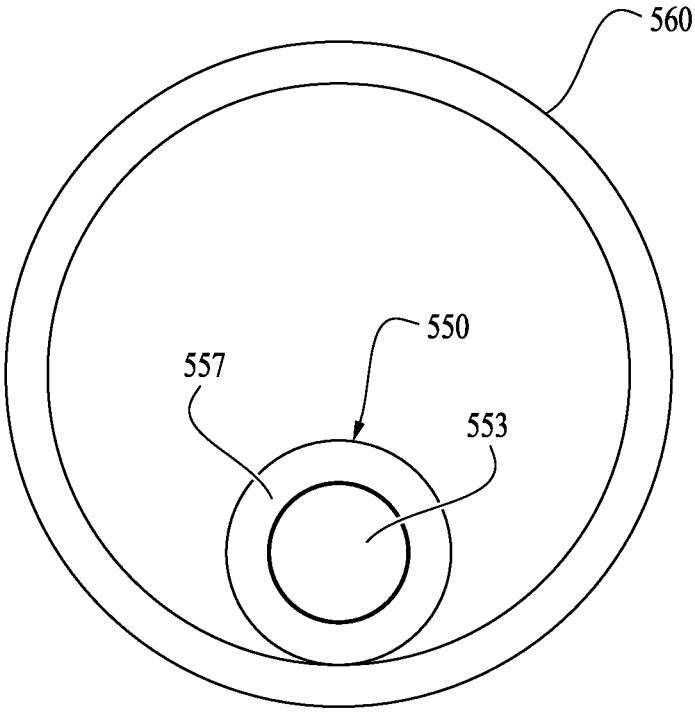
FIG. 7B illustrates a radially sectioned elevation view of the exemplary coiled tubing embodiment of FIG. 7A, according to embodiments of this disclosure.

FIG. 7A illustrates a longitudinally sectioned elevation view of an exemplary coiled tubing 422 embodiment, while FIG. 7B illustrates a radially sectioned view of the exemplary coiled tubing 422 embodiment of FIG. 7A. Exemplary coiled tubing 422 embodiments for pulsed-power drilling downhole operations may comprise a flexible hollow fluid tube 560, configured to transport drilling fluid (e.g. drilling mud) therein (e.g. the length of the fluid tube 560, from a first end to a second end), and a flexible cable conduit (which may be a cable tube 550 in some embodiments). The cable conduit typically extends substantially the length of the fluid tube 560 (e.g. having a conduit length which is substantially the same as, perhaps slightly longer than, the length of the fluid tube 560) and comprises one or more cable 553. Both the fluid tube 560 and the cable conduit are sufficiently flexible to be rolled onto a spool 450 (e.g. jointly, as when the cable tube 550 is disposed within the fluid tube 560), allowing this exemplary coiled tubing 422 to be transported and provided on a spool 450. While FIGS. 7A-7B illustrate an exemplary embodiment in which there is only a single cable conduit (for example, disposed within the fluid tube 560), having one or more cables 553 therein, in other embodiments the coiled tubing 422 may include a plurality of cable conduits, each having one or more cables therein. For example, in some embodiments, each cable for the coiled tubing 422 may be housed within its own cable conduit (e.g. each cable conduit may have only one cable therein). In some embodiments, such a plurality of cable conduits may be coupled together (e.g. by ties or a twist orientation), but in other embodiments, the plurality of cable conduits may be independent of each other (e.g. not linked physically). While the remaining discussion regarding cable conduits of coiled tubing 422 embodiments may be specifically with respect to the embodiment shown in FIGS. 7A-7B (e.g. in which there is only a single cable conduit, which houses all of the cables 553 for the coiled tubing 422), it should be understood that the coiled tubing 422 embodiments disclosed herein are not so limited and are intended to include embodiments with multiple cable conduits.

In embodiments, the one or more cable 553 within the cable conduit (e.g. cable tube 550) may comprise a power cable 553*a* for transmitting power from the surface power source (e.g. generator 140) to the pulse-power drill bit 114. The one or more cable 553 within the cable conduit may further comprise one or more selected from the following: a communication cable, fiber optic cable, a coaxial cable, and an auxiliary power cable. As shown in FIG. 5, the one or more cable 553 within the cable conduit may comprise a power cable 553*a*, a communication cable 553*b*, and a fiber-optic cable 553*c*.

In some embodiments, the fluid tube 560 can have an outer diameter of approximately 4.5 inches. In embodiments, the cable tube 550 can have an outer diameter of approximately 1.5 inches or, in some instances, no greater than 1.5 inches. In embodiments, the fluid tube 560 can have a wall thickness of approximately 0.3-0.25 inches. In embodiments, the length of the fluid tube 560 may be between approximately 2,000 and 20,000 feet, between approximately 2,000 and 15,000 feet, between approximately 2,000 and 10,000 feet, between approximately 10,000 and 20,000 feet, or between approximately 10,000 and 15,000 feet. In embodiments, the power cable 553*a* may comprise at least No. 1 conductor. In embodiments, the power cable 553*a* can be capable of transmitting approximately 5 kV and 200A (or any other power requirement for the pulsed-power drill and/or the pulse-generating circuit)).

In the coiled tubing 422 embodiment shown in FIGS. 7A-B, the cable conduit (e.g. cable tube 550) may be disposed within the fluid tube 560. In some embodiments, the cable conduit and the fluid tube 560 may be concentrically arranged, while in other embodiments, the inner cable conduit may be disposed anywhere within the outer fluid tube 560. This configuration may allow for the outer fluid tube 560 to protect and support the inner cable conduit. In some embodiments, the cable conduit may be a cable tube 550, which may comprise hollow protective tubing 557, with the one or more cables 553 disposed therein and extending substantially the length of (e.g. slightly longer than) the protective tubing 557. In embodiments, the cable tube 550 may be anchored or fixed to the fluid tube 560 at both ends (e.g. with each end of the cable tube 550 being anchored to a corresponding end of the fluid tube 560). In embodiments, the portion of the cable tube 550 between the anchored ends may be free floating within the fluid tube 560 (e.g. not attached and having sufficient length (e.g. typically greater than the length of the fluid tube 560) so that the cable tube 550 is not taut (even if the fluid tube 560 is taut) and/or does not carry any of the weight of any drill string tools disposed at the downhole end 514 of the coiled tubing 422). Such a configuration may allow the fluid tube 560 to fully support the cable tube 550, for example preventing the cable tube 550 for experiencing any forces due to weight of the fluid tube 560 and/or the tool string 108.

In some embodiments, the one or more cables 553 of the cable tube 550 may be anchored to the protective tubing 557 of the cable tube 550 at both ends (e.g. with each end of each cable 553 being anchored/fixed to a corresponding end of the protective tubing 557). In embodiments, the portion of each cable 553 between the anchored ends may be free floating within the protective tubing 557 of the cable tube 550 (e.g. not attached and having sufficient length (e.g.

greater than the length of the protective tubing 557) so that the one or more cable 553 is not taut (even if the protective tubing 557 is taut) and/or does not carry any of the weight of any portion of the protective tubing 557, the fluid tube 560, and/or the tool string 108). Such a configuration may allow the protective tube to fully support the cables 553 therein.

The cable tube 550 may comprise a power cable for transmitting power from the surface power source (e.g. generator 140) downhole. The one or more cable 553 within the cable conduit may further comprise one or more selected from the following: a communication cable, fiber optic cable, a coaxial cable, and an auxiliary power cable. As shown in FIG. 5, the one or more cable 553 within the cable conduit may comprise a power cable, a communication cable, and a fiber-optic cable. In embodiments, the power cable may be configured to safely transmit approximately 5 kV, 15-20 kV, 5-15 kV, 5-20 kV, 200A, and/or up to approximately 150 kV.

As shown in FIG. 5, the coiled tubing 422 may include a connector at each end. The connector may be configured to connect the coiled tubing 422 ends for hydraulic, electrical (e.g. power and/or signals), and/or fiber-optic connection and/or communication. For example, the connector may be configured so that the uphole end 512 of the coiled tubing 422 connects to the coiled tubing input interface subsystem 510 at the surface (allowing communication therebetween), while the downhole end 514 of the coiled tubing 422 connects to the distribution subsystem 518 at the top of the tool string 108 (allowing communication therebetween). In some embodiments, the connector at the first end may be configured to be capable of mating with (e.g. matingly engage) the connector at the second end (e.g. the connector at the first end comprises a male connector, and the connector at the second end comprises a female connector, with the two connectors being configured to correspond for mating). Such a configuration may allow for simple linking end-to-end of multiple similar coiled tubing elements 605, for example with the downhole connector of one coiled tubing element connecting to the uphole connector of another axially adjacent coiled tubing element. In some embodiments, the connector at each end may be configured to provide anchoring/fixing of one or more elements with respect to one or more other elements. For example, the connector at each end may be configured to anchor the cable tube 550 to the fluid tube 560 in some embodiments. In some embodiments, the connector at each end may be configured to anchor the one or more cable 553 to the protective tubing 557 of the cable tube 550.

In some embodiments, the connector at each end of the cable tube 550 may comprise an integrated multi-connector. For example, the integrated multi-connector may comprise a 3-in-1 connector 520 configured to simultaneously fluidly connect the fluid tube 560, connect the power cable, and connect the communication and/or fiber-optic cable (e.g. with a single connection making all of these communicative connections, allowing communication of fluid, power, and communication signals therethrough to the respective elements). For example, a 3-in-1 integrated multi-connector 520*b* may be used at the uphole end 512 of the coiled tubing 422 to provide connection (e.g. hydraulic for the drilling fluid, electric for the power, and either electric or fiber-optic for the telemetry/communication signals) to the coiled tubing input interface subsystem 510 at the surface (or to a similar uphole coiled tubing element), and another (e.g. matingly compatible) 3-in-1 integrated multi-connector 520*a* may be used at the downhole end 514 of the coiled tubing 422 to provide connection (e.g. hydraulic for the drilling fluid, electric for the power, and either electric or fiber-optic for the telemetry/communication signals) to the distribution subsystem 518 of the tool string 108 in the wellbore (or to a similar downhole coiled tubing element). As shown in FIG. 5, the coiled tubing input interface subsystem 510 may have a 3-in-1 integrated multi-connector 520*a* (compatible with 520*b* at the uphole end of the coiled tubing 422), and the distribution subsystem 518 of the tool string 108 may have a 3-in-1 integrated multi-connector 520*b* (compatible with 520*a* at the downhole end of the coiled tubing 422).

While FIG. 5 illustrates such a 3-in-1 integrated multi-connector 520 embodiment, in other embodiments the connector may comprise one or more separate connectors. For example, there may be a separate connector for each cable 553 end, a separate connector for each end of the protective tubing 557, and/or a separate connector for each end of the fluid tube 560. Alternatively, one or more separate connector may be used at each end in conjunction with one or more integrated multi-connector. For example, a single integrated multi-connector may be used at each end for all of the cables 553 of the cable tube 550, while the protective tubing connector and/or fluid tube connector at each end may be a separate connector. Or in another alternate embodiment, a single integrated multi-connector may be used at each end for all of the cables 553 of the cable tube 550 and for either the protective tubing 557 or the fluid tube 560, with the remaining tube element having its own separate connector. In still another embodiment, each of the cables 553 at each end may have its own separate connector, while the protective tubing 557 and the fluid tube 560 may use an integrated multi-connector (e.g. allowing simultaneous connection of the fluid tube 560 and the protective tubing 557 at each end). In yet another embodiment, only one or some (but not all) of the cables 553 at each end may have a separate connector, with the remaining cable(s) using an integrated multi-connector (which may integrate connection of the one or more cable 553 with other cable(s), with the protective tubing 557, and/or with the fluid tube 560). Or in another embodiments, a first integrated multi-connector may be used at each end for all of the cables 553, while a second integrated multi-connector may be used at each end for the protective tubing 557 and the fluid tube 560.

Figure 8A:
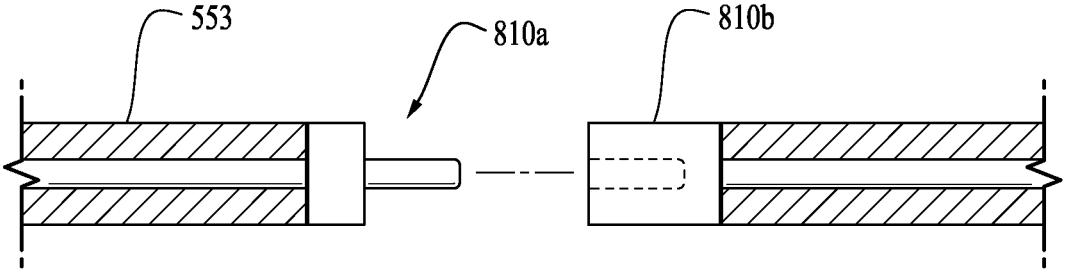
FIG. 8A illustrates schematically a longitudinal cross-sectional view of an exemplary connector for a cable within an exemplary cable tube of an exemplary coiled tubing embodiment, according to embodiments of this disclosure.
Figure 8B:
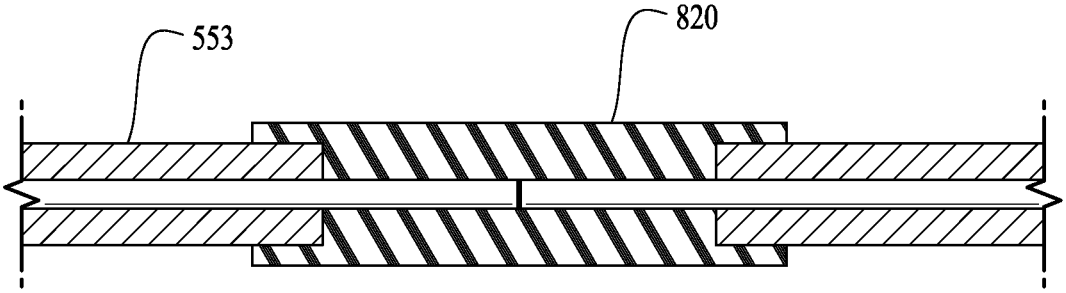
FIG. 8B illustrates schematically a longitudinal cross-sectional view of another exemplary connector for a cable within an exemplary cable tube of an exemplary coiled tubing embodiment, according to embodiments of this disclosure.

In some embodiments, the connector at each end of the cable tube 550 may comprise a separate connector for each of the one or more cable 553 (e.g. allowing each cable 553 at an end of the cable tube 550 to be connected separately/individually). For example, as shown in FIG. 8A, each cable 553 may have a separate connector 810 configured for plug-in (e.g. socket) connection (e.g. allowing plug-in connection using corresponding male 810*a* and female 810*b* connectors). In some embodiments, the separate connectors for each end of each cable 553 may comprise a clamping mechanism configured to splice a conductor of the one or more cable 553, fix the position of the conductor, and/or isolate/shield the conductor at the splice (e.g. to prevent any electrical shorting or inadvertent grounding due to a break in the insulation around the conductor in the vicinity of the splice). FIG. 8B illustrates schematically a longitudinal cross-sectional view of such an exemplary connector for a cable 553 within an exemplary cable tube 550 of an exemplary coiled tubing 422 embodiment. The conductor of the cable 553 in the coiled tube may be spliced to a conductor in either an adjacent coiled tube cable, the coiled tubing input interface subsystem 510, or the distribution subsystem 518 of the tool string 108 respectively, with the conductors abutting or overlapping and being crimped or clamped together. FIG. 8B illustrates an exemplary clamping sleeve 820, which may insulate the connection and securely fix the connection. In embodiments, each cable 553 in the cable tube 550 may be configured to be individually spliced or otherwise connected. In some embodiments, the separate connectors for each of the cables 553 at each end of the cable tube 550 may be axially spaced (e.g. with respect to each other). In embodiments, the protective tubing 557 may be wider (e.g. have a larger diameter) at the location of connection/slicing. FIGS. 8A-B are merely illustrative, and other mechanisms may be used for the connector.

In some embodiments, the connector at each end of the coiled tubing 422 may comprise a separate connector for the fluid tube 560 (e.g. to connect the fluid tube 560 of the coiled tubing 422 either to another similar fluid tube 560 of a similar coiled tubing 422, to the coiled tubing input interface subsystem 510, or to the distribution subsystem 518 of the tool string 108). In some embodiments, the connector may be configured to provide a sealing connection, for example sealingly coupling two similar fluid tubes 560 together. In some embodiments, the fluid tube connector may comprise screw threads.

In some embodiments, the connector at each end of the cable tube 550 may comprise a separate connector for the protective tubing 557 (e.g. to connect the protective tubing 557 of the cable tube 550 either to another similar protective tubing 557 of a similar coiled tubing 422, to the coiled tubing input interface subsystem 510, or to the distribution subsystem 518 of the tool string 108). In some embodiments, the connector may be configured to provide a sealing connection, for example sealingly coupling two similar protective tubings 557 together. In some embodiments, the protective tubing connector may comprise screw threads.

Figure 8C:
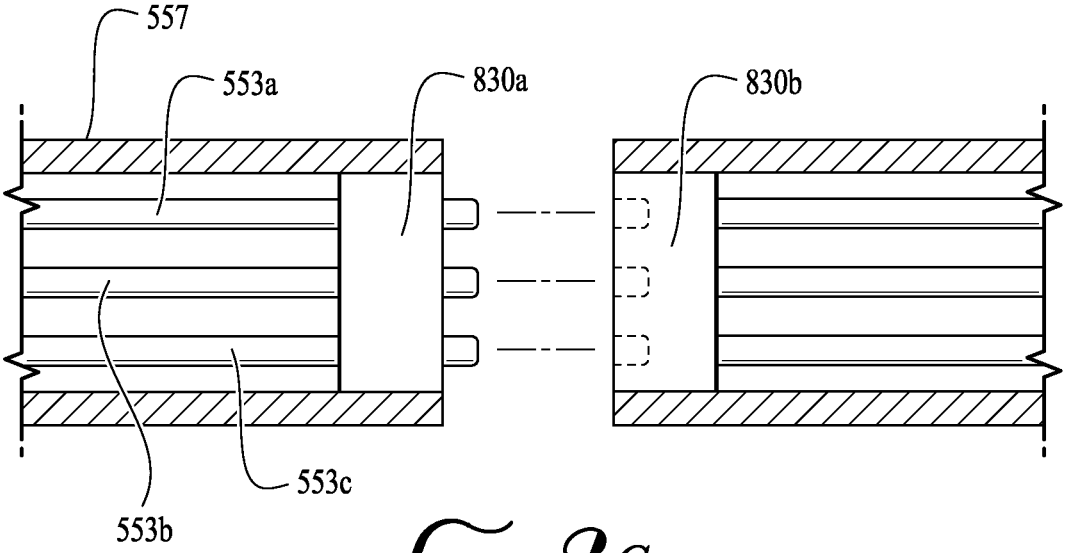
FIG. 8C illustrates schematically a longitudinal cross-sectional view of an exemplary connector for multiple cables within an exemplary cable tube of an exemplary coiled tubing embodiment, according to embodiments of this disclosure.

In some embodiments, the connector at each end of the cable tube 550 may comprise an integrated multi-connector configured so that connection (e.g. mating attachment) of the integrated multi-connector connects (e.g. matingly) each of the one or more cable 553 (e.g. allowing each cable 553 at an end of the cable tube 550 to be plugged in simultaneously). FIG. 8C illustrates such an exemplary embodiment, with an integrated multi-connector 830 *a, b* for all cables 553 in a cable tube 550. In FIG. 8C, plugging in the integrated multi-connector 830 simultaneously plugs in each cable 553 of the cable tube 550. FIG. 8C is merely illustrative, and other mechanisms may be used for the integrated multi-connector.

Figure 8D:
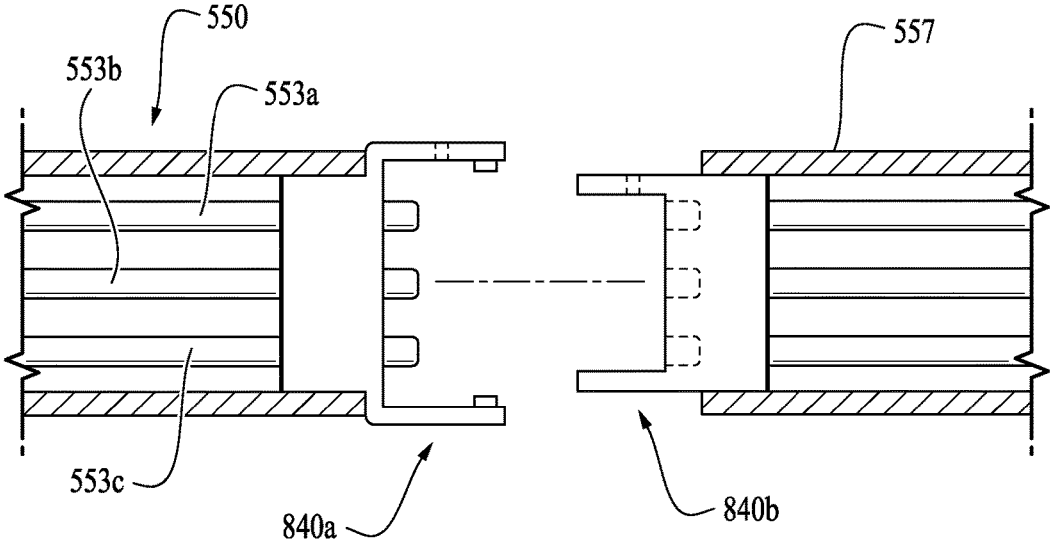
FIG. 8D illustrates schematically a longitudinal cross-sectional view of an exemplary connector for an exemplary cable tube of an exemplary coiled tubing embodiment, according to embodiments of this disclosure.

In the embodiment shown in FIG. 8D, the integrated multi-connector 840 *a, b* may be configured so that mating attachment further connects the protective tubing 557 of the cable tube 550, in addition to connecting the cables 553 of the cable tube 550 (e.g. sealingly coupling an end of the protective tubing 557 to a similar protective tubing or to a tool string distribution system or to an input distribution system). For example, the integrated multi-connector 840 may include a seal 842 element to provide a water-tight connection to prevent ingress of drilling fluid from the fluid tube 560 into the cable tube 550. In embodiments, the connector may serve to anchor the cables 553 to the protective tubing 557. FIG. 8D is merely illustrative, and other mechanisms may be used for the integrated multi-connector.

Figure 8E:
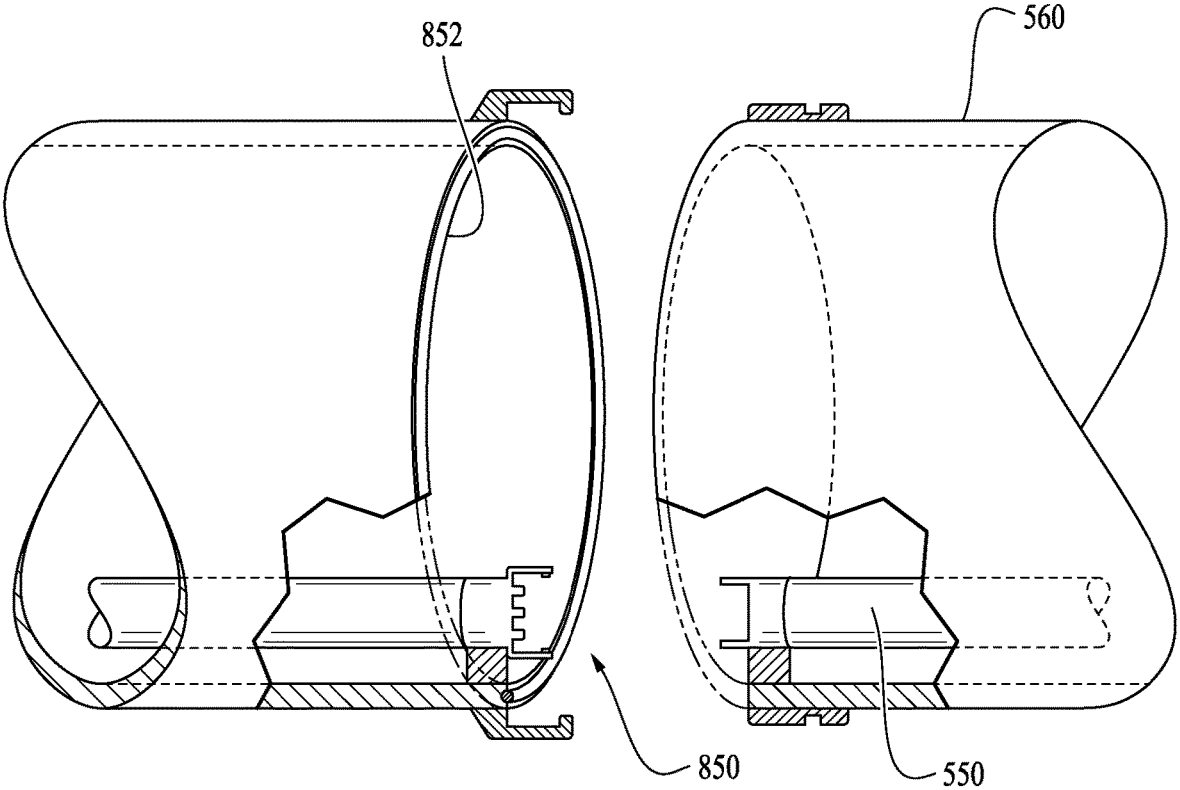
FIG. 8E illustrates schematically a longitudinal cross-sectional view of an exemplary connector for exemplary coiled tubing, according to embodiments of this disclosure.

In the embodiment of FIG. 8E, the integrated multi-connector 850 may be configured so that mating attachment further connects the fluid tube 560 of the coiled tubing 422, in addition to connecting the cables 553 of the cable tube 550 and the protective tubing 557 of the cable tube 550 (e.g. sealingly coupling an end of the fluid tube 560 to a similar fluid tube 560 or to a tool string distribution system or to an input distribution system). In embodiments, the integrated multi-connector may include a seal element 852 to provide a water-tight connection to prevent ingress of drilling fluid from the wellbore into the fluid tube 560 or egress of drilling fluid from the fluid tube 560 out to the wellbore. In embodiments, the connector may serve to anchor the cable tube 550 to the fluid tube 560. FIG. 8E is merely illustrative, and other mechanisms may be used for the integrated multi-connector.

In some embodiments, the coiled tubing 422 may comprise two or more coiled tubing elements 605 coupled end-to-end (e.g. in series) to allow fluid flow therethrough from an uphole end 512 of a first coiled tubing element to a downhole end 514 of a second coiled tubing element. FIG. 6A illustrates such an embodiment. For example, each coiled tubing element 605 may comprise a fluid tubing element and a cable tube element. By connecting the connectors of the corresponding ends of adjacent coiled tubing elements, hydraulic, electrical, and/or fiber-optic communications may pass therebetween.

In embodiments, the protective tubing 557 of the cable tube 550 may be configured to protect the one or more cable 553 therein from drilling fluid within the fluid tube 560. For example, the protective tubing 557 may be sufficiently corrosive and/or abrasive resistant so that the drilling fluid in the fluid tube 560 does not damage the protective tubing 557 enough to allow ingress of the drilling fluid into the cable tube 550 in a way that might compromise the cables therein. In embodiments, the outer fluid tube 560 may have sufficient mechanical strength to support a drilling tool string 108, as well as sufficiently corrosion and/or abrasion resistance to protect the cable tube 550 from drilling fluid outside the fluid tube 560 in the wellbore with fractured rock cuttings (e.g. rocks pieces from pulsed-power drilling) circulating uphole outside of the fluid tube 560. In some embodiments, the outer fluid tube 560 may have greater mechanical strength that the inner cable tube 550. In some embodiments, the outer fluid tube 560 may be more resistant to abrasion and/or puncture and/or wear than the inner cable tube 550 (e.g. since exposed to fluid with fractured rock cuttings). In some embodiments, the outer fluid tube 560 and the inner cable tube 550 may have similar corrosion resistance, while in other embodiments the outer fluid tube 560 may be more resistant to corrosion than the inner cable tube 550. In some embodiments, the fluid tube 560 may have greater wall thickness than the protective tubing 557 of the cable tube 550. In some embodiments, the fluid tube 560 and the inner cable tube 550 may be formed of different materials. In some embodiment, the fluid tube 560 and the protective tube may be formed of similar material, with the fluid tube 560 having a greater wall thickness. In some embodiments, one or more of the cables 553 within a cable tube 550 may have a sheathing of insulating material around conductor, for example to prevent electrical contact with the cable tube 550 (e.g, particularly if the cable tube 550 is metal).

In some embodiments, the fluid tube 560 may have similar characteristic to general coiled tubing 422, for example as discussed above with respect to FIG. 4. For example, the fluid tube 560 may be formed of steel. In some embodiments, the inner diameter of the fluid tube 560 may be sufficient for effective drilling fluid flow downhole and circulation uphole to remove fractured rock cuttings during pulsed-power drilling operations (e.g. despite the presence of the inner cable tube 550 within the outer fluid tube 560). In some embodiments, the fluid tube 560 may be configured to transport dielectric drilling fluid.

In embodiments, for example as shown in FIGS. 7A-B, the coiled tubing 422 may have a smooth exterior surface (e.g. a smooth cylindrical surface), integral power cable, and no loose or separate power line. Some embodiments of the coiled tubing 422 may further comprise one or more safety sensor (e.g. disposed in the connector). Some embodiments of the coiled tubing 422 may further comprise an interlock system 570 (e.g. configured to provide and/or detect a secure connection).

In some embodiments, the cable conduit/cable tube 550 may be disposed on an interior surface of the fluid tube 560. For example, the cable conduit/cable tube 550 may be secured to the interior surface of the fluid tube 560 for substantially its entire length. And while the cable conduit is generally described herein as being disposed within the fluid tube 560 (which may have benefits when rolling and unrolling the coiled tubing 422 on a spool 450, for example), in other embodiments the cable conduit may be disposed on an exterior surface of the fluid tube 560 (see for example, FIG. 6A). Some or all of the features of the inner cable tube 550 may apply equally to an exterior cable conduit in various embodiments.

Disclosed embodiments may also include methods of forming coiled tubing 422 having an inner cable tube 550 within an outer fluid tube 560. Exemplary methods may comprise providing the cable tube 550 having one or more cables 553 disposed within protective tubing 557; forming the fluid tube 560 to encompass the inner cable tube 550; and anchoring both ends of the cable tube 550 to the fluid tube 560. In some embodiments, a remainder of the length of the cable tube 550 (e.g. between the anchored ends) may be free-floating within the fluid tube 560. This may include leaving sufficient slack in the cable tube 550 so that the cable tube 550 is supported by the fluid tube 560 and does not carry any weight. In some embodiments, the cables 553 within the protective tubing 557 of the cable tube 550 may be anchored at both ends of the cable tube 550 (e.g. with the remainder of the length of the cables free-floating). Thus, the cables 553 within the protective tubing 557 of the cable tube 550 may have sufficient slack so that the cables 553 are supported by the protective tubing 557 (e.g. carry no load).

In embodiments, the cable tube 550 may further comprise one or more connector disposed at each end. For example, the one or more connectors may anchor the cables 553 to the protective tubing 557 and/or may be configured to provide removable coupling/connect. In some embodiments, the one or more connectors may comprise a protective tubing connector configured to provide a seal (e.g. a sealed connection). In some embodiments, the fluid tube 560 may be configured with a connector at each end to allow for connection/coupling to a fluid element. In embodiments, the fluid tube connector may be configured to provide a seal. In some embodiments, the fluid tube connector may be configured so that connection of the fluid tube 560 automatically ensures connection of the cable tube 550 and the cables 553 therein.

The method embodiments may further comprise selecting material for the fluid tube 560 and the protective tubing 557. For example, the fluid tube 560 material may be more resistant to abrasion and puncture than the protective tubing 557 material. The method embodiments may further comprise selecting wall thickness for the fluid tube 560 and the protective tubing 557. In some embodiments, the fluid tube 560 and the protective tubing 557 may be formed of the same or similar material, but the fluid tube 560 may have a thicker wall thickness.

Method embodiments may further comprise selecting a first length for the fluid tube 560 and a second length for the protective tubing 557, wherein the second length is (slightly) greater than the first length. Method embodiments may further comprise selecting a third length for each of the cables 553 of the cable tube 550, wherein the third length is greater than the second length. It should be understood that one or more of the cables 553 may have a distinct length, but for example each of the cables in such an embodiment may have a length greater than the second length.

In some embodiments, forming the fluid tube 560 to encompass the inner cable tube 550 may comprise pulling the cable tube 550 through a hollow bore of the fluid tube 560. In other embodiments, forming the fluid tube 560 to encompass the inner cable tube 550 may comprise manufacturing the outer fluid tube 560 around the inner cable tube 550. For example, the outer fluid tube 560 can be formed and rolled into a circular/cylindrical/tubular shape with the already assembled inner cable tube(s) 550 in place (e.g. during the rolling process), for example with the material (e.g. metal/steel plate) for the fluid tube 560 being rolled around the cable tube(s) 550 so that the cable tube(s) 550 will be in position inside the fluid tube 560 once the rolling and welding (e.g. the rolled material for the fluid tube 560 may be welded into final tubular shape) are completed.

In some embodiments, providing the cable tube 550 may comprise forming the cable tube 550 having one or more cables 553 extending lengthwise through the protective tubing 557. For example, forming the cable tube 550 may comprise pulling the one or more cables 553 through the hollow bore of the protective tubing 557. In other embodiments, forming the cable tube 550 may comprise manufacturing the protective tubing 557 around the one or more cables 553. For example, the inner cable tube(s) 550 may first (e.g. before formation of the fluid tube 560) be manufactured as a completed assembly using similar rolling methods as discussed above with respect to the fluid tube 560. For example, the material (e.g. metal/steel plate) of the protective tubing 557 may be rolled around the one or more cables 553 (e.g. into tubular shape), with subsequent laser (or other) welding of the rolled protective tubing 557 to form the cable tube 550 assembly. The entire cable tube 550 assembly can then optionally be pulled through a dye to reduce the tube diameter, for example to provide an interference fit of the protective tubing 557 over the one or more cables 553 (e.g. the power cable).

Disclosed embodiments also include methods of drilling a wellbore. For example, method embodiments may comprise connecting and/or coupling a tool string 108 having a pulsed power drill bit to a downhole end 514 of coiled tubing 422; deploying (e.g. running) the coiled tubing 422 downhole; directing and/or supplying power to the tool string 108 via the coiled tubing 422 (e.g. via the cable tube 550 within the fluid tube 560); providing drilling fluid downhole through the coiled tubing 422 (e.g. via the fluid tube 560); and drilling the wellbore using the pulsed-power drill bit 114. The coiled tubing 422 may comprise any embodiments disclosed herein, for example with the coiled tubing 422 having a flexible hollow fluid tube 560 configured to transport drilling fluid therein; and a flexible cable tube 550 disposed within the fluid tube 560, wherein the cable tube 550 extends substantially the length of the fluid tube 560 and comprises one or more cable 553 disposed within protective tubing 557. In some embodiments, the drilling fluid may be dielectric. In embodiments, drilling fluid and power may be simultaneously provided downhole through the coiled tubing 422 (e.g. with the protective tubing 557 protecting the cables 553 from the drilling fluid within the fluid tubing, as the cables transmit power, etc.).

Embodiments may further comprise boosting the voltage of the power supplied through the coiled tubing 422, for example using a pulse-generating circuit in the tool string 108 (e.g. as previously discussed). Deploying the coiled tubing 422 downhole may comprise deploying (e.g. from a spool 450 of coiled tubing 422 on the surface) an amount of coiled tubing 422 sufficient to reach a desired drilling depth. Directing/supplying power may comprise selecting the amount of power based on the length of the coiled tubing 422 (e.g. less power for lesser depths, and more power for greater depths) and/or altering the amount of power supplied based on the length of the coiled tubing 422 in the wellbore.

Some embodiments may further comprise connecting/coupling an uphole end 512 of the coiled tubing 422 to an input interface subsystem at the surface. A generator 140 or other power source may provide power to the input interface subsystem. A mud pump 125 may provide drilling fluid to the input interface subsystem. In some embodiments, the coiled tubing 422 may comprise two coiled tubing elements 605, and the method may further comprise connecting a downhole end 514 of a second of the two coiled tubing elements to an uphole end 512 of a first of the two coiled tubing elements.

In embodiments, connecting (with respect to the coiled tubing 422) may comprise connecting fluidly (e.g. the fluid tube 560) and electrically/power (e.g. the cable tube 550 and its cables). In some embodiments, connecting cables 553 may comprise splicing, wherein the splices are axially spaced. In some embodiments, connecting may comprise connecting mating terminals for each cable 553. In some embodiments, connecting may comprise connecting a single integrated multi-connector, whereby connecting the single integrated multi-connector connects all cables 553 simultaneously. In some embodiments, connecting may further comprise connecting the protective tubing 557 of the cable tube 550 (e.g. to provide a fluid-tight connection, so no drilling fluid can enter the cable tube 550 to contact the cables 553 therein). In some embodiments, connecting may further comprise connecting the fluid tubing (e.g. to provide a fluid-tight connection, so that drilling fluid does not leak out of the fluid tube 560 but is effectively directed downhole to the pulsed-power drill bit 114). In some embodiments, connecting cables 553 may comprise forming (e.g. splicing) connections radially outward (e.g. starting inward and working outward). In some embodiments, connecting cables 553 may comprise forming (e.g. splicing) connections which are axially spaced. Some embodiments may further comprise sensing the connection(s) (e.g. using an interlock system 570) to ensure that all connections are effectively made. In some embodiments, a signal may be sent to indicate a good connection, a bad connection, or both.

In embodiments, there may be no power generation downhole. For example, all power for the pulsed-power drill bit 114 may be transmitted downhole through the coiled tubing 422 and/or all power generation for the pulsed-power drilling system may be at the surface. In some embodiments, at least a portion of the wellbore may extend or be drilled at an angle from vertical (e.g. at least a portion of the wellbore is non-vertical). For example, at least a portion of the wellbore can be drilled at an angle of approximately 10-90, 15-90, 20-90, 25-90, 30-90, 35-90, 40-90, 45-90, 50-90, 55-90, 60-90, 65-90, 70-90, 75-90, 80-90, 85-90, 10-60, 20-50, 30-75, 40-80, 20-70, 25-60, approximately 90, or even greater than 90 degrees from vertical (e.g. where 90 degrees from vertical would represent horizontal). Some embodiments of the method may further comprise steering the tool string 108. For example, control/command signals may be transmitted downhole through the coiled tubing 422, which may allow control of the path of the pulsed-power drill bit 114 and/or the wellbore. The flexibility of the coiled tubing 422 may allow for greater angles for drilling of the wellbore and/or within wells formed by pulsed-power drill bit 114*s* (e.g. compared to drill pipe conveyance). Some embodiments may further comprise transmitting signals (e.g. sensor signals) to the surface though the coiled tubing 422.

In embodiments, the coiled tubing 422 may be rewound/re-rolled onto the spool 450 during removal from the wellbore. For example, method embodiments may further comprise retracting the tool string 108 from the wellbore to the surface by rolling the coiled tubing 422 onto the spool 450. Some method embodiments may comprise controlling the depth of the tool string 108/pulsed-power drill (e.g. the position in the wellbore) by rolling and unrolling coiled tubing 422 from the spool 450 on the surface.

ADDITIONAL DISCLOSURE

The following are non-limiting, specific embodiments in accordance with the present disclosure:

In a first embodiment, a coiled tubing comprises: a flexible hollow fluid tube having a length and configured to transport drilling fluid the length of the fluid tube, from a first end to a second end; and a flexible cable conduit; wherein the cable conduit extends substantially the length of the fluid tube and comprises one or more cable; and wherein both the fluid tube and the cable conduit are sufficiently flexible to be rolled onto a spool.

A second embodiment can include the coiled tubing of the first embodiment, wherein the one or more cable within the cable conduit comprises a power cable for transmitting power from a surface power source to a pulsed-power drill bit.

A third embodiment can include the coiled tubing of the second embodiment, wherein the one or more cable within the cable conduit further comprises one or more selected from the following: a communication cable, a fiber optic cable, a coaxial cable, and an auxiliary power cable.

A fourth embodiment can include the coiled tubing of the first embodiment, wherein the one or more cable comprises a power cable, a communication cable, and a fiber-optic cable.

A fifth embodiment can include the coiled tubing of any one of the first to fourth embodiments, wherein: the cable conduit is a cable tube comprising protective tubing, with the one or more cables disposed therein; the cable tube is disposed within the fluid tube.

A sixth embodiment can include the coiled tubing of the fifth embodiment, wherein the cable tube is anchored to the fluid tube at both ends.

A seventh embodiment can include the coiled tubing of the sixth embodiment, wherein between the anchored ends, the cable tube is free floating within the fluid tube.

An eighth embodiment can include the coiled tubing of any one of the fifth to seventh embodiments, wherein the one or more cables are anchored to the protective tubing of the cable tube at both ends.

A ninth embodiment can include the coiled tubing of the eighth embodiment, wherein between the anchored ends, the one or more cables within the cable tube are free floating within the protective tubing.

A tenth embodiment can include the coiled tubing of any one of the fifth to ninth embodiments, wherein the cable tube further comprises a connector at each end.

An eleventh embodiment can include the coiled tubing of the tenth embodiment, wherein the connector at each end comprises a separate connector for each of the one or more cable.

A twelfth embodiment can include the coiled tubing of the tenth embodiment, wherein the connector at each end comprises an integrated multi-connector configured so that connection of the integrated multi-connector simultaneously connects each of the one or more cable.

A thirteenth embodiment can include the coiled tubing of the twelfth embodiment, wherein the integrated multi-connector is configured so that connection of the integrated multi-connector further connects the protective tubing of the cable tube.

A fourteenth embodiment can include the coiled tubing of the thirteenth embodiment, wherein the protective tubing is sealingly connected.

A fifteenth embodiment can include the coiled tubing of any one of the twelfth to fourteenth embodiments, wherein the integrated multi-connector is configured so that connection of the integrated multi-connector further connects the fluid tube of the coiled tubing.

A sixteenth embodiment can include the coiled tubing of the fifteenth embodiment, wherein the fluid tube is sealingly connected.

A seventeenth embodiment can include the coiled tubing of the tenth embodiment, wherein the connector is configured to connect the coiled tubing ends for hydraulic, electrical (e.g. power and/or signals), and/or fiber-optic connection and/or communication.

An eighteenth embodiment can include the coiled tubing of the tenth or seventeenth embodiment, wherein the connector at the first end may be configured to mate with (e.g. matingly engage) the connector at the second end (e.g. the connector at the first end comprises a male connector, and the connector at the second end comprises a female connector, with the two connectors being configured to correspond for mating A nineteenth embodiment can include the coiled tubing of any one of the tenth, seventeenth, or eighteenth embodiment, wherein the connector at each end is configured to anchor the cable tube to the fluid tube.

A twentieth embodiment can include the coiled tubing of any one of the tenth or seventeenth to nineteenth embodiment, wherein the connector at each end may be configured to anchor the one or more cable to the protective tubing of the cable tube.

A twenty-first embodiment can include the coiled tubing of any one of the tenth or seventeenth to twentieth embodiment, wherein the connector at each end of the cable tube may comprise an integrated multi-connector.

A twenty-second embodiment can include the coiled tubing of the twenty-first embodiment, wherein the integrated multi-connector may comprise a 3-in-1 connector configured to simultaneously fluidly connect the fluid tube, connect the power cable, and connect the communication and/or fiber-optic cable (e.g. with a single connection making all of these communicative connections, allowing communication of fluid, power, and communication signals therethrough to the respective elements).

A twenty-third embodiment can include the coiled tubing of any one of the tenth or seventeenth to twentieth embodiment, wherein the connector at each end of the cable tube may comprise a separate connector for each of the one or more cable (e.g. allowing each cable at an end of the cable tube to be connected separately/individually).

A twenty-fourth embodiment can include the coiled tubing of the twenty-third embodiment, wherein each cable comprises a separate connector configured for plug-in connection.

A twenty-fifth embodiment can include the coiled tubing of the twenty-third embodiment, wherein the separate connector for each end of each cable may comprise a clamping mechanism configured to splice a conductor of the one or more cable, fix the position of the conductor, and/or isolate the conductor at the splice.

A twenty-sixth embodiment can include the coiled tubing of the twenty-fifth embodiment, wherein the clamping mechanism comprises a clamping sleeve.

A twenty-seventh embodiment can include the coiled tubing of any one of the twenty-third to twenty-sixth embodiment, wherein each cable in the cable tube may be configured to be individually spliced, plugged-in, or connected.

A twenty-eighth embodiment can include the coiled tubing of any one of the twenty-third to twenty-seventh embodiment, wherein the separate connectors for the cables at each end of the cable tube may be axially spaced (e.g. with respect to each other).

A twenty-ninth embodiment can include the coiled tubing of any one of the twenty-third to twenty-eighth embodiment, wherein the protective tubing may be wider (e.g. have a larger diameter) at the location of connection.

A thirtieth embodiment can include the coiled tubing of any one of the twenty-third to twenty-ninth embodiment, wherein the connector at each end of the coiled tubing may comprise a separate connector for the fluid tube.

A thirty-first embodiment can include the coiled tubing of any one of the twenty-third to thirtieth embodiment, wherein the fluid tube connector may comprise screw threads.

A thirty-second embodiment can include the coiled tubing of any one of the twenty-third to thirty-first embodiment, wherein the connector at each end of the cable tube may comprise a separate connector for the protective tubing.

A thirty-third embodiment can include the coiled tubing of any one of the twenty-third to thirty-second embodiment, wherein the protective tubing connector comprises screw threads.

A thirty-fourth embodiment can include the coiled tubing of any one of the first to thirty-third embodiment, wherein the coiled tubing comprises two or more coiled tubing elements coupled end-to-end (e.g. in series) to allow fluid flow therethrough from an uphole end of a first coiled tubing element to a downhole end of a second coiled tubing element.

A thirty-fifth embodiment can include the coiled tubing of the thirty-fourth embodiment, wherein each coiled tubing element comprises a fluid tubing element and a cable tube element.

A thirty-sixth embodiment can include the coiled tubing of any one of the fifth to the thirty-fifth embodiment, wherein the protective tubing of the cable tube is configured to protect the one or more cables therein from drilling fluid within the fluid tube.

A thirty-seventh embodiment can include the coiled tubing of any one of the first to the thirty-sixth embodiment, wherein the outer fluid tube has sufficient mechanical strength to support a drilling tool string, as well as sufficiently corrosion and/or abrasion resistant to protect the cable tube from drilling fluid with fractured rock cuttings circulating uphole outside of the fluid tube.

A thirty-eighth embodiment can include the coiled tubing of any one of the first to thirty-seventh embodiment, wherein the outer fluid tube has greater mechanical strength that the inner cable tube.

A thirty-ninth embodiment can include the coiled tubing of any one of the first to thirty-eighth embodiment, wherein the outer fluid tube is more resistant to abrasion and/or puncture than the inner cable tube.

A fortieth embodiment can include the coiled tubing of any one of the fifth to the thirty-ninth embodiment, wherein the fluid tube and the protective tube are formed of similar material, with the fluid tube having a greater wall thickness.

A forty-first embodiment can include the coiled tubing of any one of the first to the fortieth embodiment, wherein the inner diameter of the fluid tube is sufficient for effective drilling fluid flow downhole and circulation uphole to remove fractured rock cuttings (e.g. despite the presence of the inner cable tube within the outer fluid tube).

A forty-second embodiment can include the coiled tubing of any one of the first to forty-first embodiment, wherein the coiled tubing has a smooth cylindrical exterior surface, integral power cable, and no loose or separate power line.

A forty-third embodiment can include the coiled tubing of any one of the first to forty-second embodiment, further comprising one or more safety sensor (e.g. disposed in the connector).

A forty-fourth embodiment can include the coiled tubing of any one of the first to the forty-third embodiment, further comprising an interlock system (e.g. configured to provide and/or detect a secure connection).

A forty-fifth embodiment can include the coiled tubing of any one of the first to the fourth embodiment, wherein the cable conduit/cable tube is disposed on an exterior surface of the fluid tube.

In a forty-sixth embodiment, a pulsed-power drilling system comprises: the coiled tubing of any one of the first to forty-fifth embodiments; a coiled tubing input interface subsystem disposed at the surface; and a tool string.

A forty-seventh embodiment can include the system of the forty-sixth embodiment, wherein the coiled tubing further comprises: an uphole end of the coiled tubing configured to connect/couple to the coiled tubing input interface (e.g. to provide hydraulic connection for the outer fluid tube, electrical connection of for the power cable of the inner cable tube, and electrical and/or fiber optic connection for the telemetry/communication of the inner cable tube), and a downhole end of the coiled tubing configured to connect/couple to a distribution subsystem of the tool string (e.g. to provide hydraulic connection for the outer fluid tube, electrical connection of for the power cable of the inner cable tube, and electrical and/or fiber optic connection for the telemetry/communication of the inner cable tube).

A forty-eighth embodiment can include the system of the forty-sixth or forty-seventh embodiment, wherein the tool string is disposed/coupled at the downhole end of the coiled tubing, and the coiled tubing input interface subsystem is disposed/coupled at the uphole end of the coiled tubing.

A forty-ninth embodiment can include the system of any one of the forty-sixth to forty-eighth embodiment, wherein power and drilling fluid simultaneously flow from the coiled tubing input interface subsystem to the tool string via the coiled tubing.

A fiftieth embodiment can include the system of any one of the forty-sixth to forty-ninth embodiment, wherein the coiled tubing extends downhole in a wellbore.

A fifty-first embodiment can include the system of any one of the forty-sixth to fiftieth embodiment, wherein the tool string comprises a pulsed-power drill bit.

A fifty-second embodiment can include the system of any one of the forty-sixth to fifty-first embodiment, wherein the tool string further comprises telemetry, MWD 532, power boosting (e.g. pulse generating circuit), sensors, and/or steering.

A fifty-third embodiment can include the system of any one of the forty-sixth to fifty-second embodiment, further comprising a generator or other power source configured to provide power to the power cable via the coiled tubing input interface subsystem.

A fifty-fourth embodiment can include the system of any one of the forty-sixth to fifty-third embodiment, further comprising a mud pump configured to provide drilling fluid to the fluid tube of the coiled tubing via the coiled tubing input interface subsystem and/or to pump the drilling fluid downhole to the tool string through the fluid tube of the coiled tubing.

A fifty-fifth embodiment can include the system of any one of the forty-sixth to fifty-fourth embodiment, further comprising a safety interlock system configured to provide and/or detect secure connections (e.g. of the fluid tube, the power cable, etc.).

A fifty-sixth embodiment can include the system of the fifty-fifth embodiment, wherein the safety interlock system is disposed within the coiled tubing input interface subsystem, the tool string, and/or the coiled tubing (e.g. the connector).

A fifty-seventh embodiment can include the system of any one of the forty-sixth to fifty-sixth embodiment, further comprising a spool (e.g. disposed at the surface), wherein at least a portion of the coiled tubing is disposed on the spool.

In a fifty-eighth embodiment, a method of forming coiled tubing (e.g. similar to that of the first to forty-fifth embodiments) having an inner cable tube within an outer fluid tube comprises: providing the cable tube having one or more cables disposed within protective tubing; forming the fluid tube to encompass the inner cable tube; and anchoring both ends of the cable tube to the fluid tube, wherein a remainder of the length of the cable tube is free-floating within the fluid tube (e.g. leaving sufficient slack in the cable tube so that the cable tube is supported by the fluid tube and does not carry any weight).

A fifty-ninth embodiment can include the method of the fifty-eighth embodiment, wherein the cables within the protective tubing of the cable tube are anchored at both ends of the cable tube (e.g. with the remainder of the length of the cables free-floating).

A sixtieth embodiment can include the method of the fifty-eighth or fifty-ninth embodiment, wherein the cable tube further comprises one or more connector disposed at each end of the cable tube, and the one or more connectors anchor the cables to the protective tubing.

A sixty-first embodiment can include the method of any one of the fifty-eighth to sixtieth embodiment, wherein the protective tubing is configured with a connector at each end to allow for connection/coupling, and the connector anchors the protective tubing to the fluid tube.

A sixty-second embodiment can include the method of any one of the fifty-eighth to sixty-first embodiment, further comprising selecting material for the fluid tube and the protective tubing, wherein the fluid tube material is more resistant to abrasion and puncture than the protective tubing material.

A sixty-third embodiment can include the method of any one of the fifty-eighth to sixty-second embodiment, wherein the fluid tube and the protective tubing are formed of the same or similar material, but the fluid tube has a thicker wall thickness.

A sixty-fourth embodiment can include the method of any one of the fifty-eighth to sixty-third embodiment, further comprising selecting a first length for the fluid tube and a second length for the protective tubing, wherein the second length is (e.g. slightly) greater than the first length.

A sixty-fifth embodiment can include the method of any one of the fifty-eighth to sixty-fourth embodiment, further comprising selecting a third length for each of the cables of the cable tube, wherein the third length is greater than the second length.

A sixty-sixth embodiment can include the method of any one of the fifty-eighth to sixty-fifth embodiment, wherein forming the fluid tube to encompass the inner cable tube comprises pulling the cable tube through a hollow bore of the fluid tube.

A sixty-seventh embodiment can include the method of any one of the fifty-eighth to sixty-fifth embodiment, wherein forming the fluid tube to encompass the inner cable tube comprises manufacturing the outer fluid tube around the inner cable tube.

A sixty-eighth embodiment can include the method of any one of the fifty-eighth to sixty-seventh embodiment, wherein providing the cable tube comprises forming the cable tube having one or more cables extending lengthwise through the protective tubing.

A sixty-ninth embodiment can include the method of any one of the fifty-eighth to sixty-eighth embodiment, wherein forming the cable tube comprises pulling the one or more cables through the hollow bore of the protective tubing.

A seventieth embodiment can include the method of any one of the fifty-eighth to sixty-eighth embodiment, wherein forming the cable tube comprises manufacturing the protective tubing around the one or more cables.

In a seventy-first embodiment, a method of drilling a wellbore comprises: connecting/coupling a tool string having a pulsed power drill bit to a downhole end of coiled tubing, wherein the coiled tubing comprises any one of the first to the forty-fifth embodiments; deploying (e.g. running) the coiled tubing downhole; directing/supplying power to the tool string via the coiled tubing (e.g. via the cable tubing within the fluid tube); providing drilling fluid downhole through the coiled tubing (e.g. via the fluid tube of the same coiled tubing); and drilling the wellbore using the pulsed-power drill bit.

A seventy-second embodiment can include the method of the seventy-first embodiment, wherein the drilling fluid is dielectric.

A seventy-third embodiment can include the method of the seventy-first or seventy-second embodiment, wherein drilling fluid and power are simultaneously provided downhole through the coiled tubing (e.g. with the protective tubing protecting the cables from the drilling fluid within the fluid tubing, as the cables transmit power, etc.).

A seventy-fourth embodiment can include the method of any one of the seventy-first to seventy-third embodiment, further comprising boosting the voltage of the power supplied through the coiled tubing using a pulse-generating circuit in the tool string.

A seventy-fifth embodiment can include the method of any one of the seventy-first to seventy-fourth embodiment, wherein deploying the coiled tubing downhole comprises deploying (e.g. from a spool of coiled tubing) an amount of coiled tubing sufficient to reach a desired drilling depth.

A seventy-sixth embodiment can include the method of any one of the seventy-first to seventy-fifth embodiment, wherein directing/supplying power comprises selecting the amount of power based on the length of the coiled tubing (e.g. less power for lesser depths, and more power for greater depths).

A seventy-seventh embodiment can include the method of any one of the seventy-first to seventy-sixth embodiment, wherein directing/supplying power comprises altering the amount of power based on the length of the coiled tubing in the wellbore.

A seventy-eighth embodiment can include the method of any one of the seventy-first to seventy-seventh embodiment, further comprising connecting/coupling an uphole end of the coiled tubing to an input interface subsystem at the surface.

A seventy-ninth embodiment can include the method of any one of the seventy-first to seventy-eighth embodiment, wherein a generator or other power source on the surface (e.g. a DC power source) provides power to the input interface subsystem, and wherein a mud pump provides drilling fluid to the input interface subsystem.

An eightieth embodiment can include the method of any one of the seventy-first to seventy-ninth embodiment, wherein the coiled tubing comprises two coiled tubing elements, further comprising connecting a downhole end of a second of the two coiled tubing elements to an uphole end of a first of the two coiled tubing elements.

An eighty-first embodiment can include the method of any one of the seventy-first to eightieth embodiment, wherein connecting comprises connecting fluidly/hydraulically (e.g. the fluid tubes) and electrically/power (e.g. the cable tube and its cables).

An eighty-second embodiment can include the method of any one of the seventy-first to eighty-first embodiment, wherein connecting cables comprises splicing, wherein the splices are axially spaced.

An eighty-third embodiment can include the method of any one of the seventy-first to eighty-second embodiment, wherein connecting comprises connecting mating terminals for each cable.

An eighty-fourth embodiment can include the method of any one of the seventy-first to eighty-first embodiment, wherein connecting comprises connecting a single integrated multi-connector, whereby connecting the single integrated multi-connector connects all cables simultaneously.

An eighty-fifth embodiment can include the method of any one of the seventy-first to eighty-fourth embodiment, wherein connecting further comprises connecting the cable tube (e.g. to provide a fluid-tight connection, so no drilling fluid can enter the cable tube to contact the cables therein).

An eighty-sixth embodiment can include the method of any one of the seventy-first to eighty-fifth embodiment, wherein connecting further comprises connecting the fluid tubing (e.g. to provide a fluid-tight connection, so that drilling fluid does not leak out of the fluid tube but is effectively directed downhole to the pulsed-power drill bit.

An eighty-seventh embodiment can include the method of any one of the seventy-first to eighty-sixth embodiment, further comprising sensing the connections (e.g. using an interlock system) to ensure that all connections are effectively made (and optionally sending a signal to indicate, a good connection, a bad connection, or both).

An eighty-eighth embodiment can include the method of any one of the seventy-first to eighty-seventh embodiment, wherein connecting cables comprises forming (e.g. splicing) connections radially outward (e.g. starting inward and working outward).

An eighty-ninth embodiment can include the method of any one of the seventy-first to eighty-eighth embodiment, wherein connecting cables comprises forming (e.g. splicing) connections which are axially spaced.

A ninetieth embodiment can include the method of any one of the seventy-first to eighty-ninth embodiment, wherein there is no power generation downhole (e.g. all power for the pulsed-power drill bit is transmitted downhole through the coiled tubing and/or all power generation for the system is at the surface).

A ninety-first embodiment can include the method of any one of the seventy-first to ninetieth embodiment, wherein at least a portion of the wellbore extends or is drilled at an angle from vertical (e.g. at least a portion of the wellbore is non-vertical).

A ninety-second embodiment can include the method of any one of the seventy-first to ninety-first embodiment, further comprising steering the tool string (e.g. via control/command signals transmitted downhole through the coiled tubing) (e.g. to control the path of the pulsed-power drill bit and/or the wellbore).

A ninety-third embodiment can include the method of any one of the seventy-first to ninety-second embodiment, wherein the flexibility of the coiled tubing allows for greater angles within wells formed by pulsed-power drill bits (e.g. compared to drill pipe).

A ninety-fourth embodiment can include the method of any one of the seventy-first to ninety-third embodiment, wherein the coiled tubing may be rewound/rerolled onto the spool during removal from the wellbore.

A ninety-fifth embodiment can include the method of any one of the seventy-first to ninety-fourth embodiment, further comprising retracting the tool string from the wellbore to the surface by rolling the coiled tubing onto the spool.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Any and all exemplary embodiments and/or the features therein which are discussed in this specification are not intended to be limiting, but merely provide non-limiting illustrative examples. Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

The invention claimed is:

1. A pulsed-power drilling system, comprising:

a coiled tubing comprising:

a flexible, hollow fluid tube having a length and configured to transport drilling fluid therein; and a flexible cable tube disposed within the fluid tube;

wherein the cable tube extends substantially the length of the fluid tube and comprises a plurality of cables disposed within protective tubing, wherein the plurality of cables comprises a power cable, a communication cable, and a fiber-optic cable;

a coiled tubing input interface subsystem disposed at a surface of a well; and a tool string comprising a pulsed-power drill bit;

wherein:

the coiled tubing further comprises:

an uphole end connector configured to connect to the coiled tubing input interface to provide hydraulic connection for the fluid tube and connection for the power cable, the communication cable, and the fiber-optic cable of the cable tube; and a downhole end connector configured to connect to a distribution subsystem of the tool string to provide hydraulic connection for the fluid tube and connection for the power cable, communication cable, and fiber-optic cable of the cable tube;

the tool string is disposed at the downhole end of the coiled tubing;

the coiled tubing input interface subsystem is disposed at the uphole end of the coiled tubing; and the power cable is configured for transmitting power from a surface power source to the pulsed-power drill bit, and the communication cable and the fiber-optic cable are configured for communication with the pulsed-power drill bit.

2. The pulsed-power drilling system of claim 1, wherein power and drilling fluid simultaneously flow from the coiled tubing input interface subsystem to the tool string via the coiled tubing.

3. The pulsed-power drilling system of claim 1, wherein the tool string further comprises a pulse generating circuit.

4. The pulsed-power drilling system of claim 1, further comprising:

a generator on the surface configured to provide power to the power cable via the coiled tubing input interface subsystem, wherein no power is generated downhole; and a pump on the surface configured to provide drilling fluid to the fluid tube of the coiled tubing via the coiled tubing input interface subsystem and to pump the drilling fluid downhole to the tool string through the fluid tube of the coiled tubing.

5. The pulsed-power drilling system of claim 1, further comprising a spool on the surface, wherein at least a portion of the coiled tubing is disposed on the spool.

6. The pulsed-power drilling system of claim 1, wherein the uphole end connector and the downhole end connector each comprises an integrated multi-connector configured so that connection of the integrated multi-connector simultaneously connects each of the plurality of cables.

7. The pulsed-power drilling system of claim 6, wherein the integrated multi-connector is configured so that connection of the integrated multi-connector further sealingly connects the protective tubing of the cable tube, and wherein the integrated multi-connector is configured so that connection of the integrated multi-connector further connects the fluid tube of the coiled tubing.

8. A coiled tubing for downhole operations comprising:

a flexible hollow fluid tube having a length and configured to transport drilling fluid the length of the fluid tube, from a first end to a second end; and a flexible cable conduit;

wherein the cable conduit extends substantially the length of the fluid tube and comprises one or more cable;

wherein both the fluid tube and the cable conduit are sufficiently flexible to be rolled onto a spool; and wherein:

the cable conduit is a cable tube comprising protective tubing, with the one or more cables disposed therein;

the cable tube is disposed within the fluid tube;

the cable tube is anchored to the fluid tube at both ends;

the cable tube further comprises a connector at each end;

the one or more cable within the cable conduit comprises a plurality of cables; and the connector at each end comprises a separate connector for each of the plurality of cables.

9. The coiled tubing of claim 8, wherein the one or more cable within the cable conduit comprises a power cable for transmitting power from a surface power source to a pulsed-power drill bit.

10. The coiled tubing of claim 9, wherein the one or more cable within the cable conduit further comprises one or more selected from the following: a communication cable, a fiber optic cable, a coaxial cable, and an auxiliary power cable.

11. The coiled tubing of claim 8, wherein the one or more cables are anchored to the protective tubing of the cable tube at both ends.

12. The coiled tubing of claim 8, wherein between the anchored ends, the cable tube is free floating within the fluid tube.

13. The coiled tubing of claim 12, wherein the one or more cables are anchored to the protective tubing of the cable tube at both ends, and wherein between the anchored ends of the cables, the one or more cables within the cable tube are free floating within the protective tubing.

14. A coiled tubing for downhole operations comprising:

a flexible hollow fluid tube having a length and configured to transport drilling fluid the length of the fluid tube, from a first end to a second end; and a flexible cable conduit;

wherein the cable conduit extends substantially the length of the fluid tube and comprises one or more cable;

wherein both the fluid tube and the cable conduit are sufficiently flexible to be rolled onto a spool; and wherein:

the cable conduit is a cable tube comprising protective tubing, with the one or more cables disposed therein;

the cable tube is disposed within the fluid tube;

the cable tube is anchored to the fluid tube at both ends;

the cable tube further comprises a connector at each end;

the one or more cable within the cable conduit comprises a plurality of cables; and the connector at each end comprises an integrated multi-connector configured so that connection of the integrated multi-connector simultaneously connects each of the plurality of cables.

15. The coiled tubing of claim 14, wherein the integrated multi-connector is configured so that connection of the integrated multi-connector further sealingly connects the protective tubing of the cable tube, and wherein the integrated multi-connector is configured so that connection of the integrated multi-connector further connects the fluid tube of the coiled tubing.

16. The coiled tubing of claim 14, wherein the one or more cable within the cable conduit comprises a power cable for transmitting power from a surface power source to a pulsed-power drill bit, and the one or more cable within the cable conduit further comprises one or more selected from the following: a communication cable, a fiber optic cable, a coaxial cable, and an auxiliary power cable.

17. The coiled tubing of claim 14, wherein between the anchored ends, the cable tube is free floating within the fluid tube; wherein the one or more cables are anchored to the protective tubing of the cable tube at both ends; and wherein between the anchored ends of the cables, the one or more cables within the cable tube are free floating within the protective tubing.

18. A method of drilling a wellbore, comprising:

connecting a tool string having a pulsed-power drill bit to a downhole end of coiled tubing, wherein the coiled tubing comprises:

a flexible hollow fluid tube having a length and configured to transport drilling fluid therein; and a flexible cable tube disposed within the fluid tube, wherein the cable tube extends substantially the length of the fluid tube and comprises one or more cable disposed within protective tubing;

deploying the coiled tubing downhole;

providing power to the tool string downhole via the coiled tubing;

providing drilling fluid to the tool string downhole via the coiled tubing; and drilling the wellbore using the pulsed-power drill bit;

wherein drilling fluid and power are simultaneously provided downhole through the coiled tubing, with the protective tubing protecting the one or more cable from the drilling fluid within the fluid tube as the one or more cable transmits power; and wherein deploying the coiled tubing downhole comprises deploying an amount of coiled tubing sufficient to reach a desired drilling depth from a spool of coiled tubing at a surface of the wellbore, and wherein providing power comprises selecting an amount of power based on the length of the coiled tubing deployed downhole.

19. The method of claim 18, further comprising connecting an uphole end of the coiled tubing to an input interface subsystem at the surface;

wherein a power source at the surface provides power to the input interface subsystem, and wherein a mud pump provides drilling fluid to the input interface subsystem.

20. The method of claim 18, further comprising steering the tool string using the coiled tubing to control the path of the pulsed-power drill bit; wherein at least a portion of the wellbore is drilled at an angle from vertical.

* * * * *